US011201407B2

(12) United States Patent
Hirabayashi et al.

(10) Patent No.: US 11,201,407 B2
(45) Date of Patent: Dec. 14, 2021

(54) ANTENNA APPARATUS AND COMMUNICATION APPARATUS

(71) Applicant: SONY SEMICONDUCTOR SOLUTIONS CORPORATION, Kanagawa (JP)

(72) Inventors: Takayuki Hirabayashi, Tokyo (JP); Masayoshi Abe, Tokyo (JP); Osamu Kozakai, Kanagawa (JP); Hiroaki Nakano, Tokyo (JP); Uichiro Omae, Kanagawa (JP)

(73) Assignee: SONY SEMICONDUCTOR SOLUTIONS CORPORATION, Kanagawa (JP)

( * ) Notice: Subject to any disclaimer, the term of this patent is extended or adjusted under 35 U.S.C. 154(b) by 0 days.

(21) Appl. No.: 16/641,334

(22) PCT Filed: Aug. 21, 2018

(86) PCT No.: PCT/JP2018/030724
§ 371 (c)(1),
(2) Date: Feb. 24, 2020

(87) PCT Pub. No.: WO2019/044570
PCT Pub. Date: Mar. 7, 2019

(65) Prior Publication Data

US 2020/0295460 A1 Sep. 17, 2020

(30) Foreign Application Priority Data

Sep. 4, 2017 (JP) ..... JP2017-169690

(51) Int. Cl.
*H01Q 7/00* (2006.01)
*H01Q 7/06* (2006.01)
*H01Q 1/24* (2006.01)

(52) U.S. Cl.
CPC ..... *H01Q 7/06* (2013.01); *H01Q 1/243* (2013.01)

(58) Field of Classification Search
CPC ..... H01Q 7/06
(Continued)

(56) References Cited

U.S. PATENT DOCUMENTS

2013/0206845 A1 12/2013 Koujima et al.
2016/0226146 A1* 8/2016 Komachi ..... H01Q 1/2225
(Continued)

FOREIGN PATENT DOCUMENTS

CN 103053075 A 4/2013
EP 2602868 A1 6/2013
(Continued)

OTHER PUBLICATIONS

International Search Report and Written Opinion of PCT Application No. PCT/JP2018/030724, dated Nov. 13, 2018, 09 pages of ISRWO.

*Primary Examiner* — Peguy Jean Pierre
(74) *Attorney, Agent, or Firm* — Chip Law Group

(57) ABSTRACT

The present technology relates an antenna apparatus and a communication apparatus that make it possible to miniaturize the antenna apparatus and improve communication performance. A solenoid-coil-type solenoid antenna and a metal plate disposed to have an overlapping portion with the solenoid antenna in a length direction of the solenoid antenna are included. The overlapping portion includes a portion corresponding to a length of 50% to 80% of a length of the solenoid antenna. Furthermore, a slit is formed in the metal plate, and the solenoid antenna is disposed in parallel to the slit. It is possible to apply the present technology to an antenna apparatus included in a communication apparatus that performs wireless communication.

16 Claims, 24 Drawing Sheets

(58) Field of Classification Search
USPC ..... 343/700 R
See application file for complete search history.

(56) References Cited

U.S. PATENT DOCUMENTS

| | | | | |
|---|---|---|---|---|
| 2017/0025758 | A1* | 1/2017 | Tomonari | H01Q 7/00 |
| 2018/0069312 | A1* | 3/2018 | Lee | H04B 5/0075 |

FOREIGN PATENT DOCUMENTS

| | | | |
|---|---|---|---|
| JP | 2012-039242 | A | 2/2012 |
| JP | 2013-013149 | A | 1/2013 |
| JP | 2014-232904 | A | 12/2014 |
| JP | 2016-129421 | A | 7/2016 |
| JP | 2017-005610 | A | 1/2017 |
| KR | 10-2013-0142991 | A | 12/2013 |
| WO | 2012/017921 | A1 | 2/2012 |

* cited by examiner

[FIG. 1]
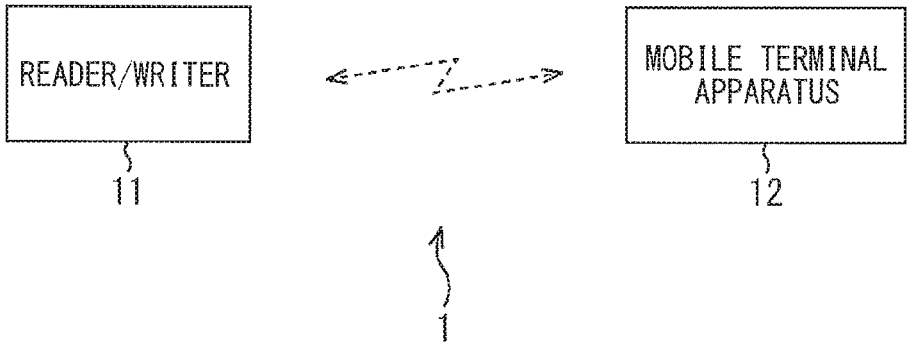

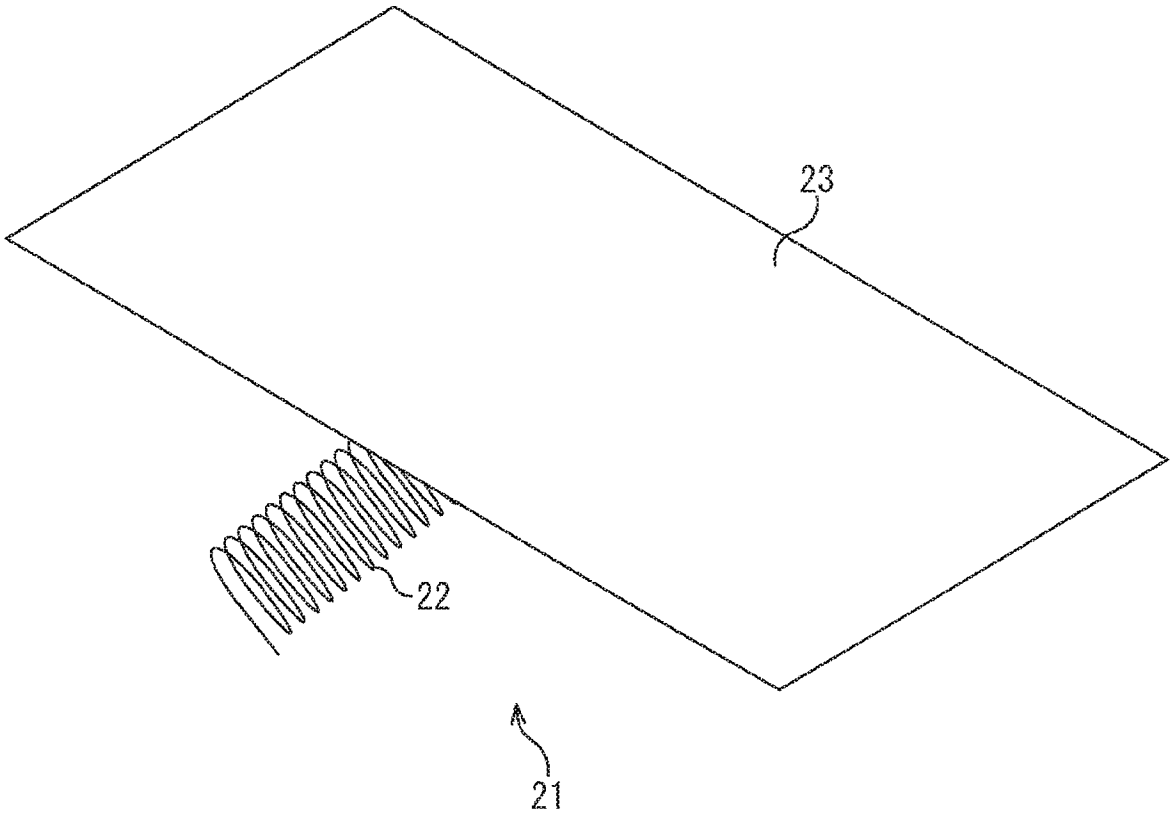
[FIG. 2]

[FIG. 3]
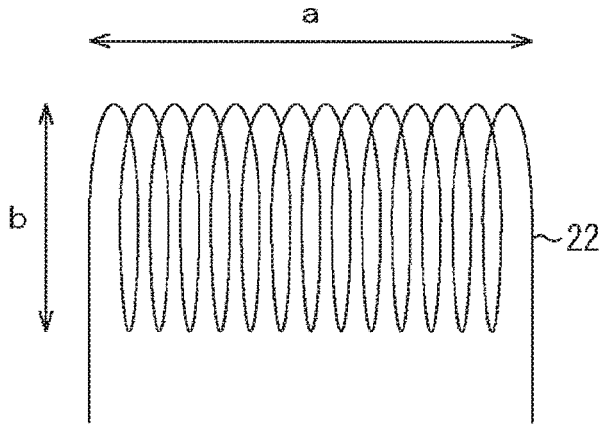

[FIG. 4B]
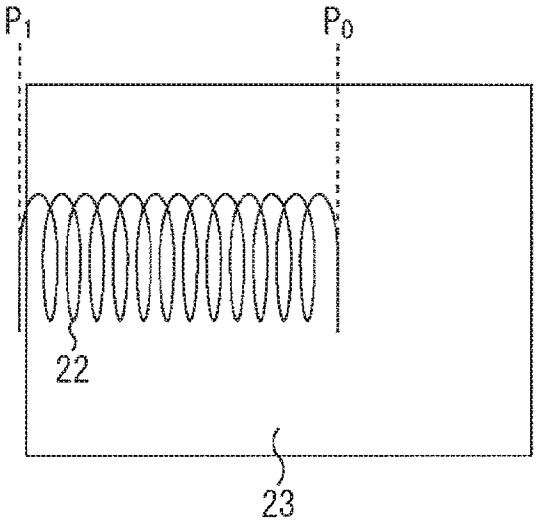
[FIG. 4A]
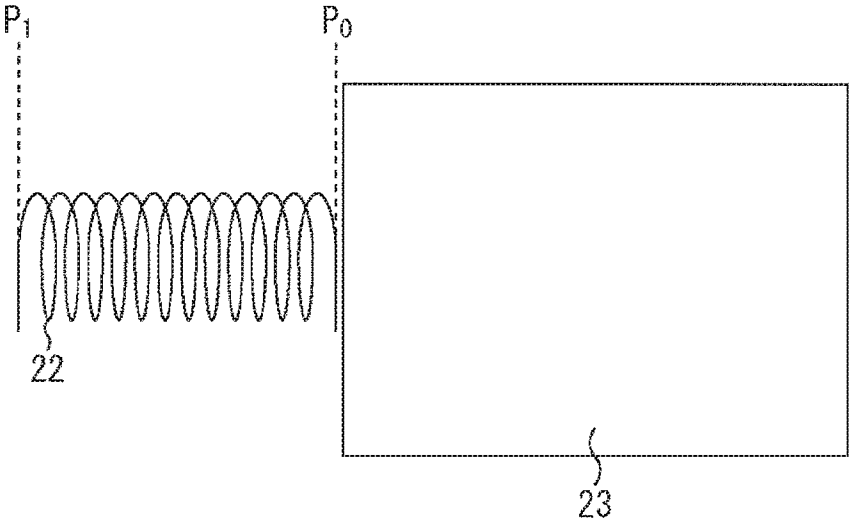

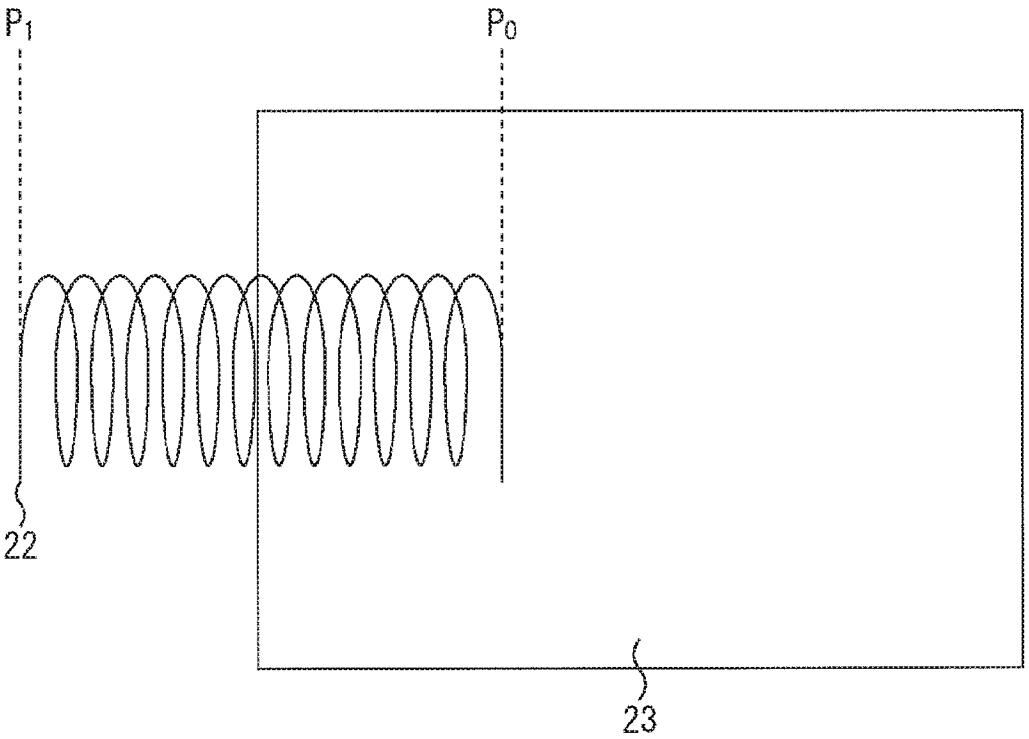
[FIG. 5]

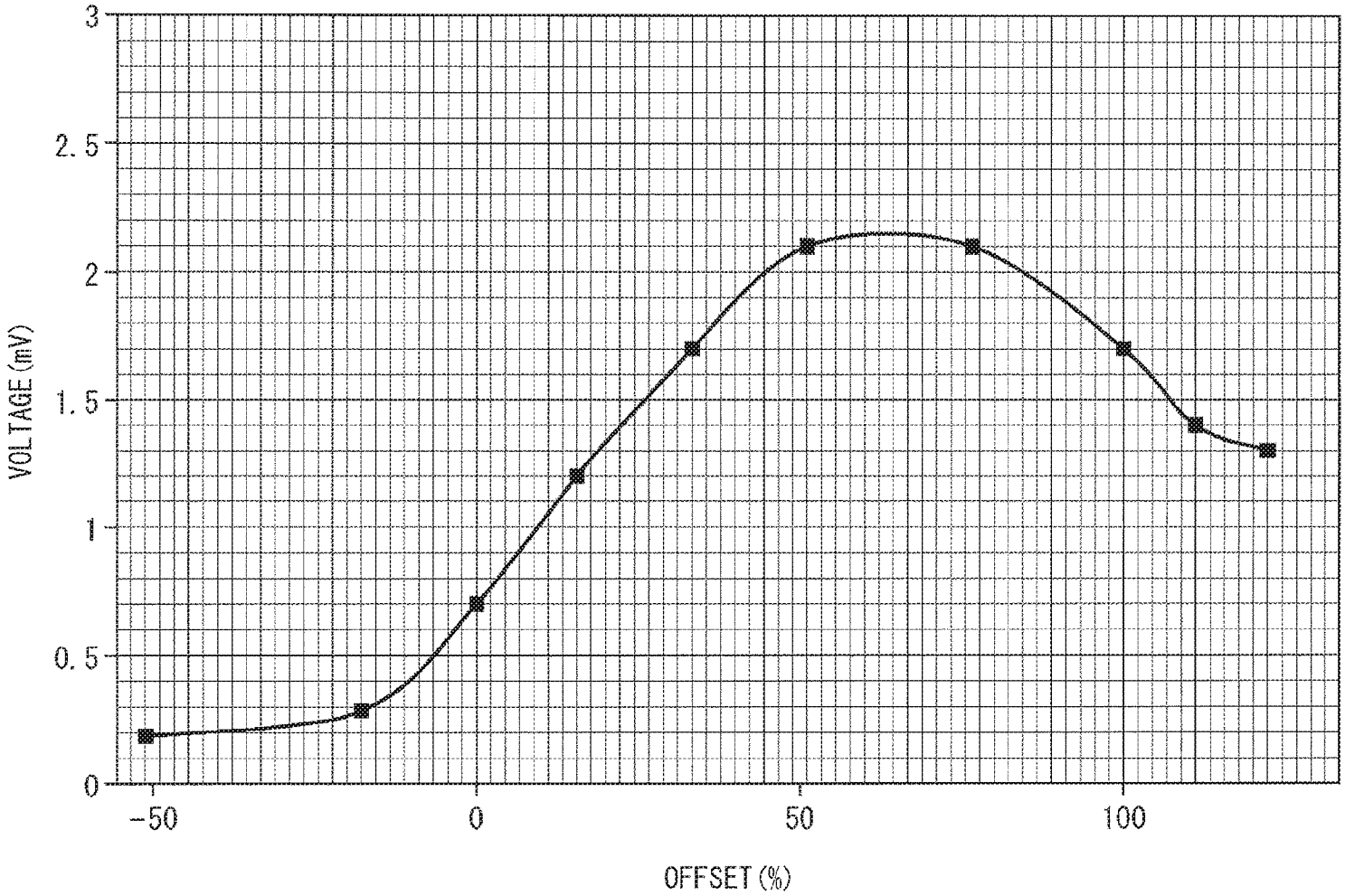
[FIG. 6]

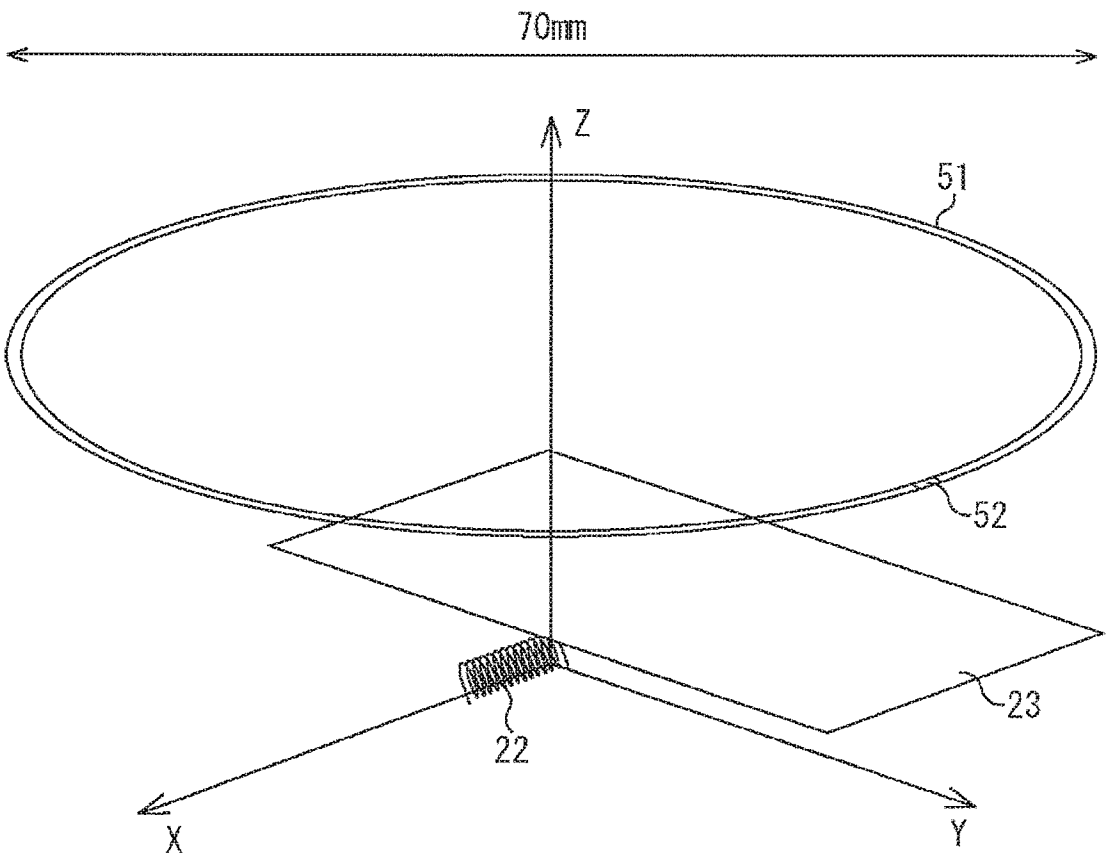
[FIG. 7]

[FIG. 8]
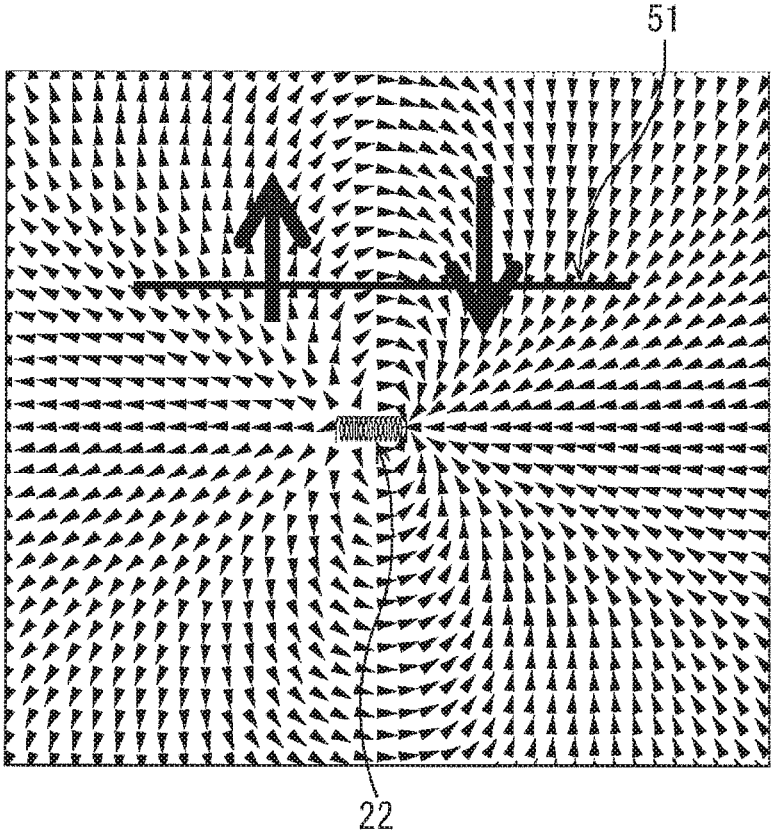

[FIG. 9]
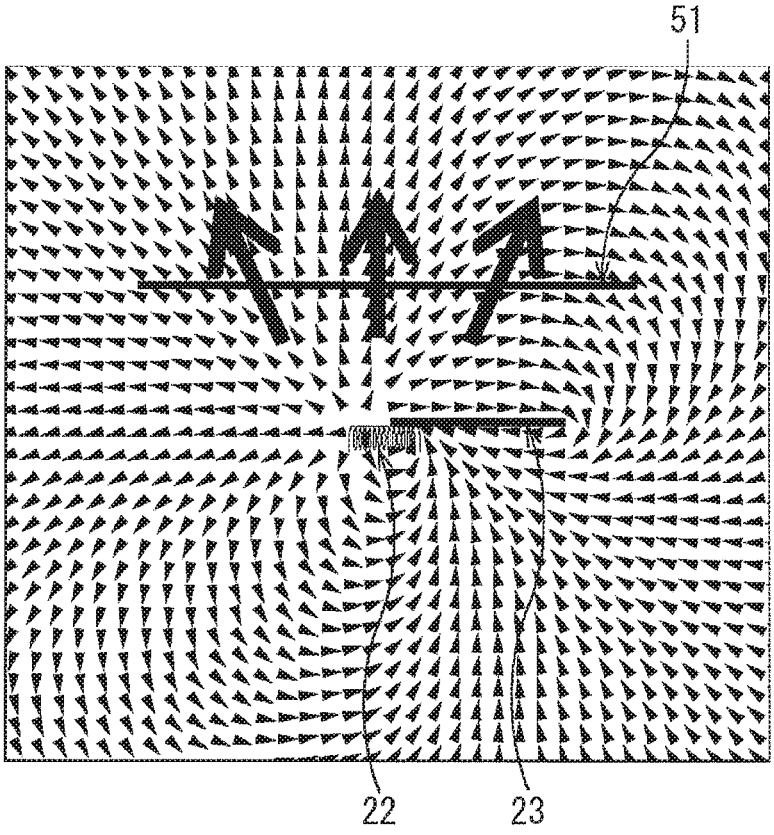

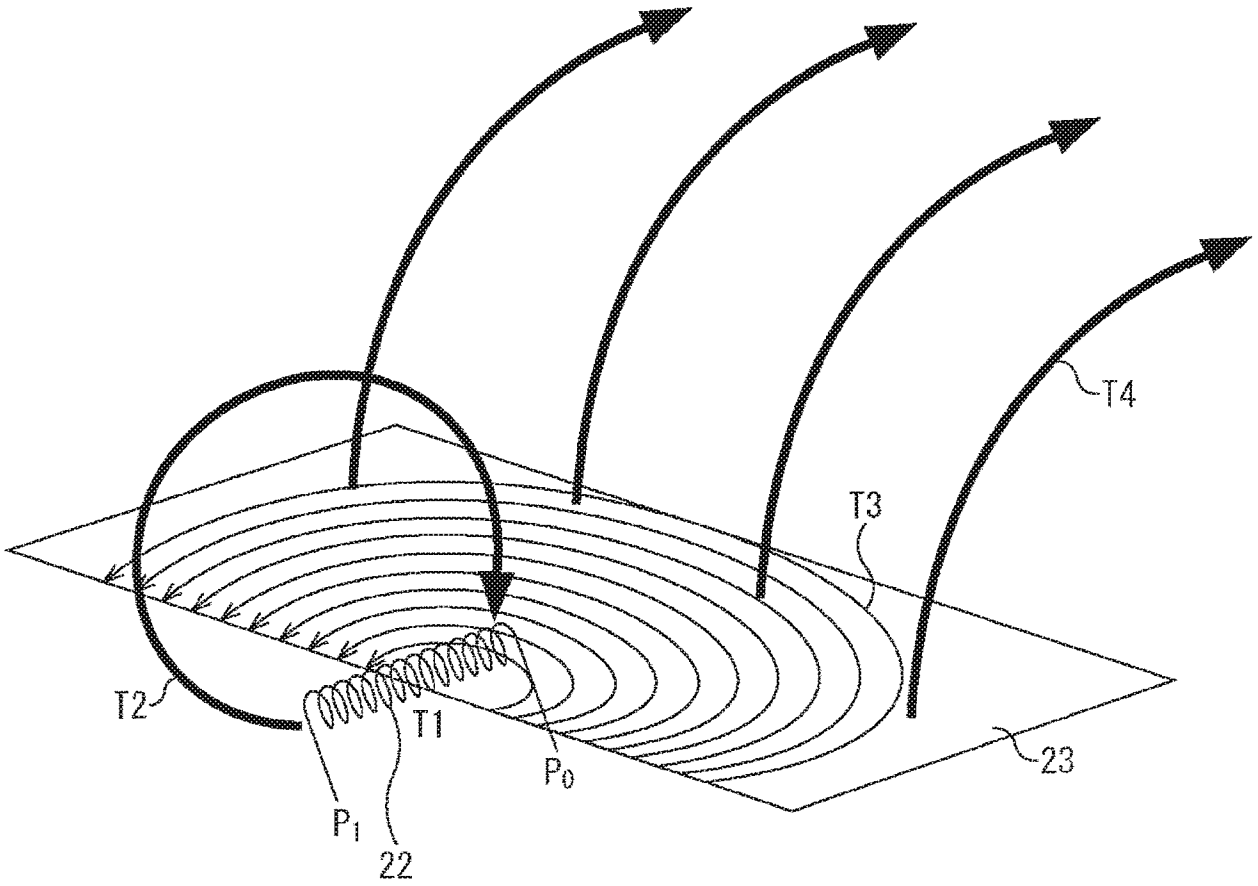
[FIG. 10]

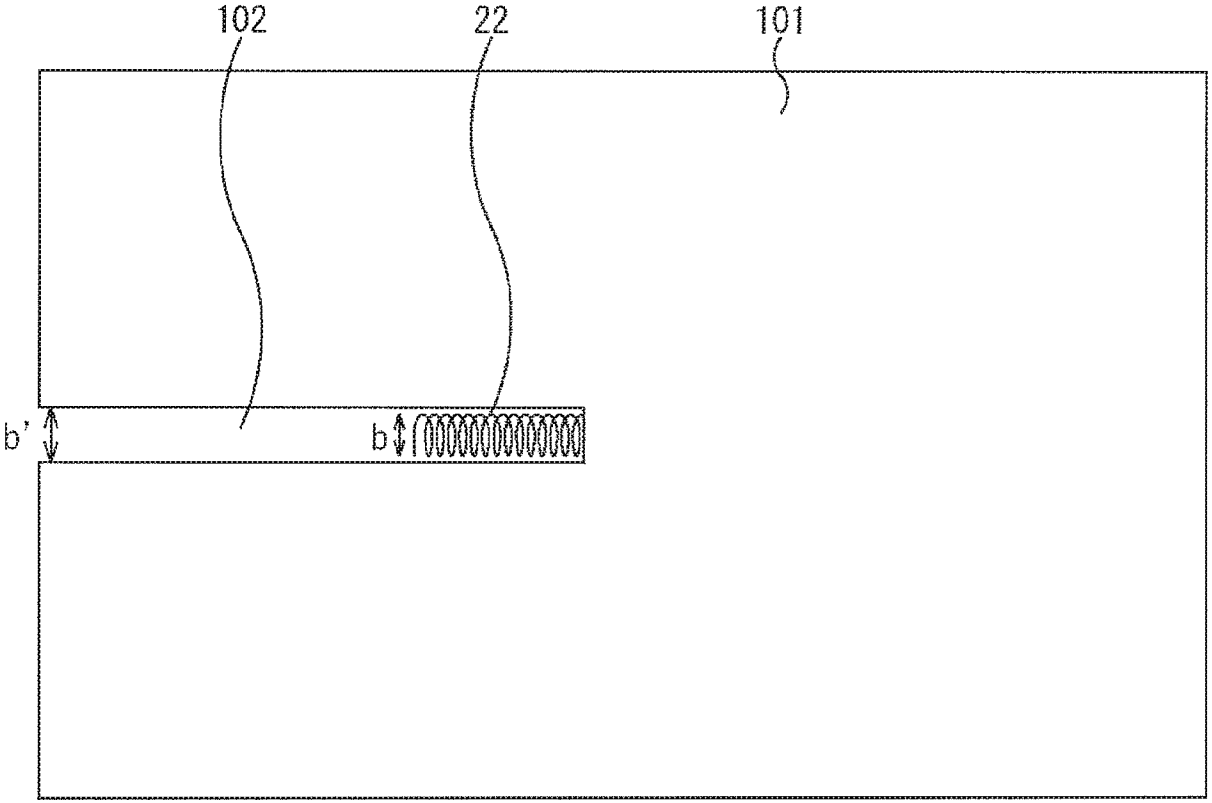
[FIG. 11]

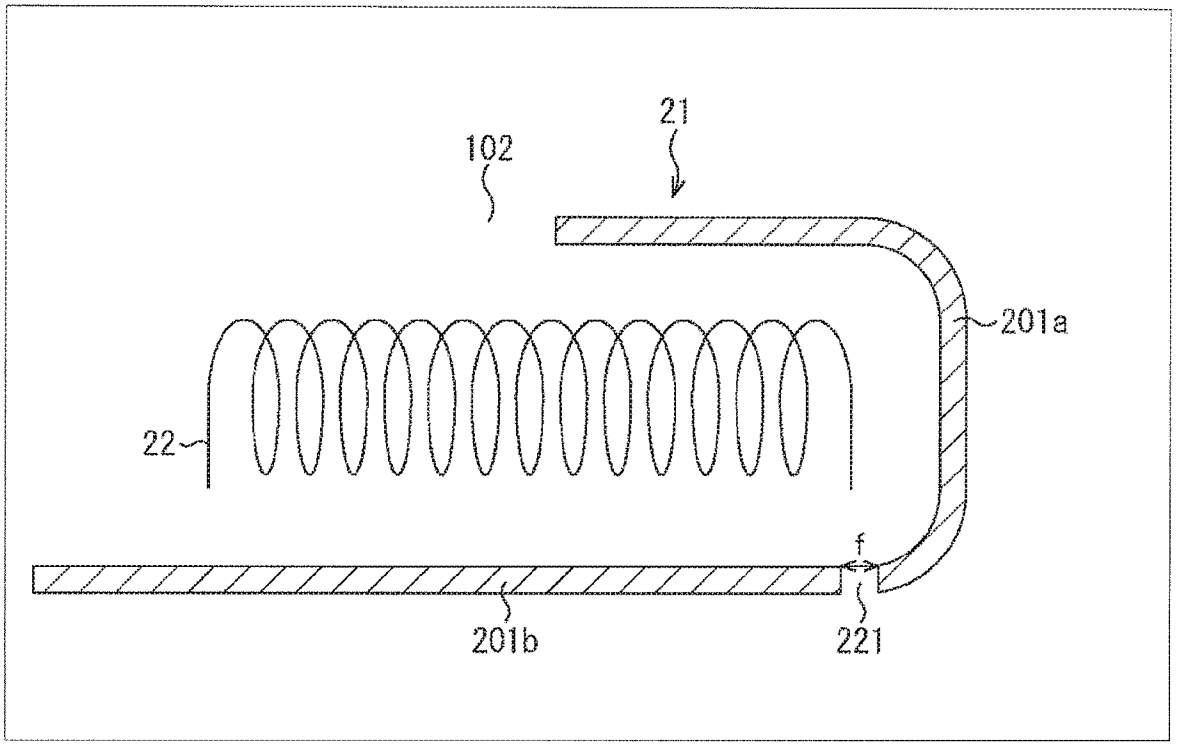
[FIG. 12]

[FIG. 13A]
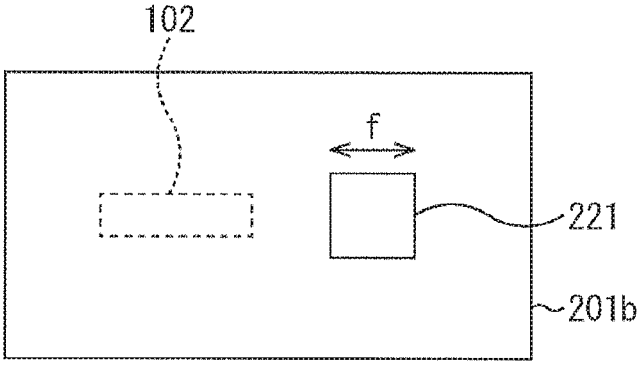
[FIG. 13B]
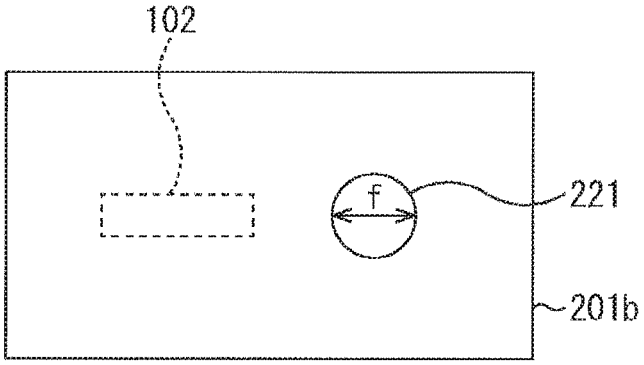
[FIG. 13C]
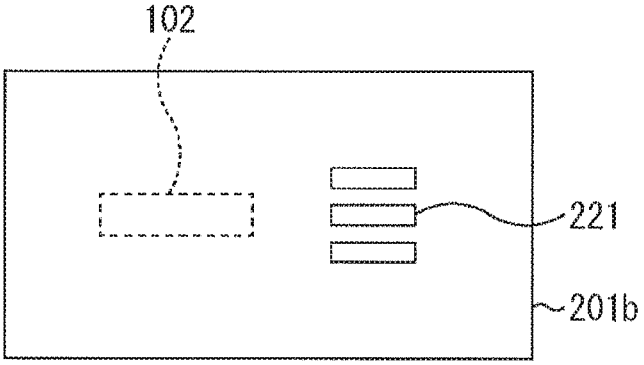

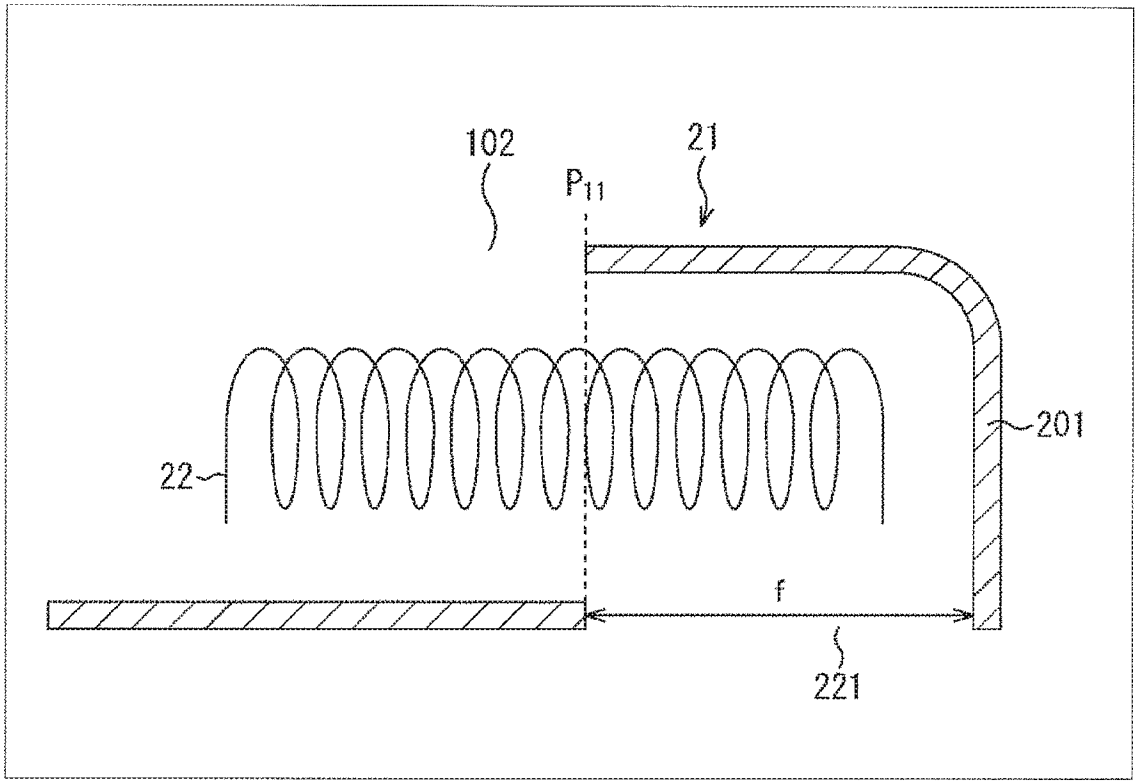
[FIG. 14]

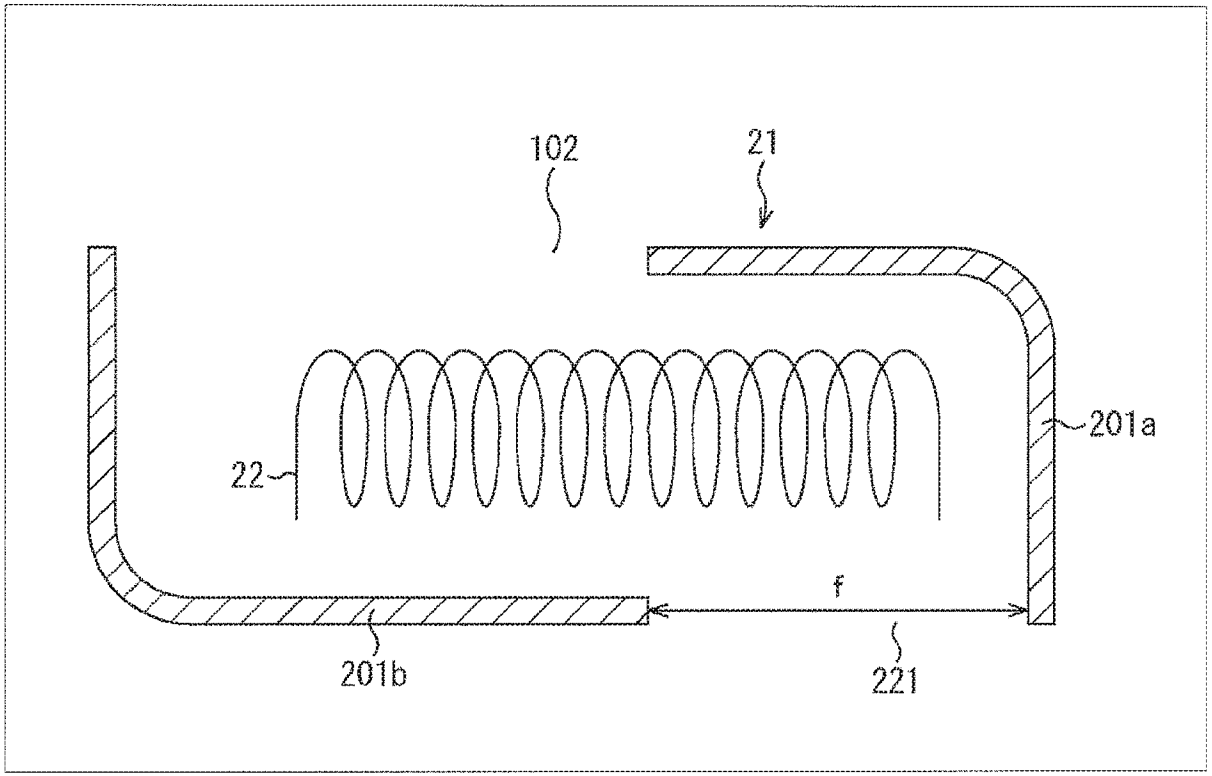
[FIG. 15]

[FIG. 16]
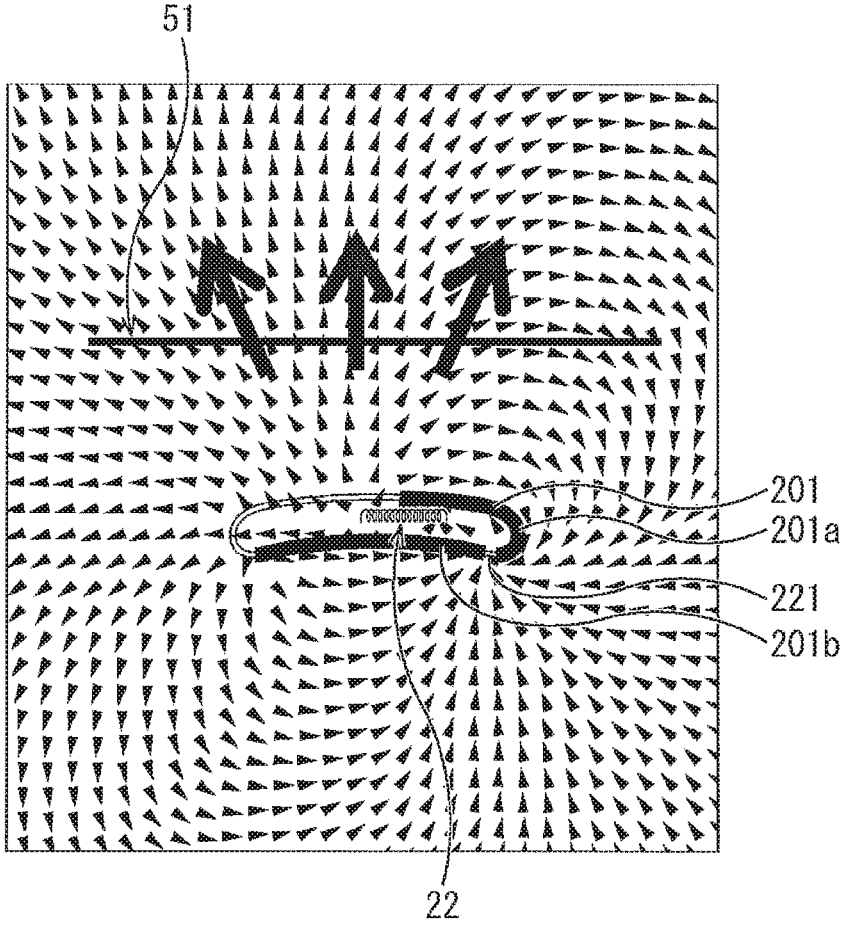

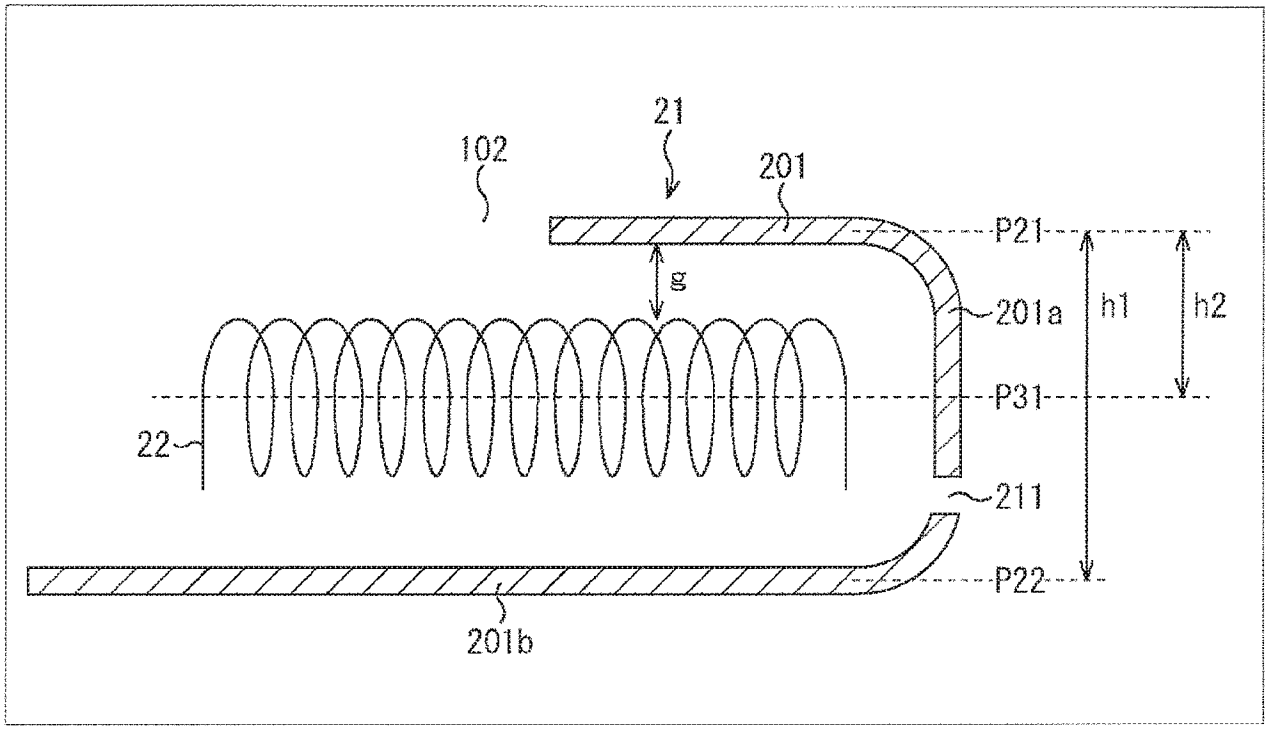
[FIG. 17]

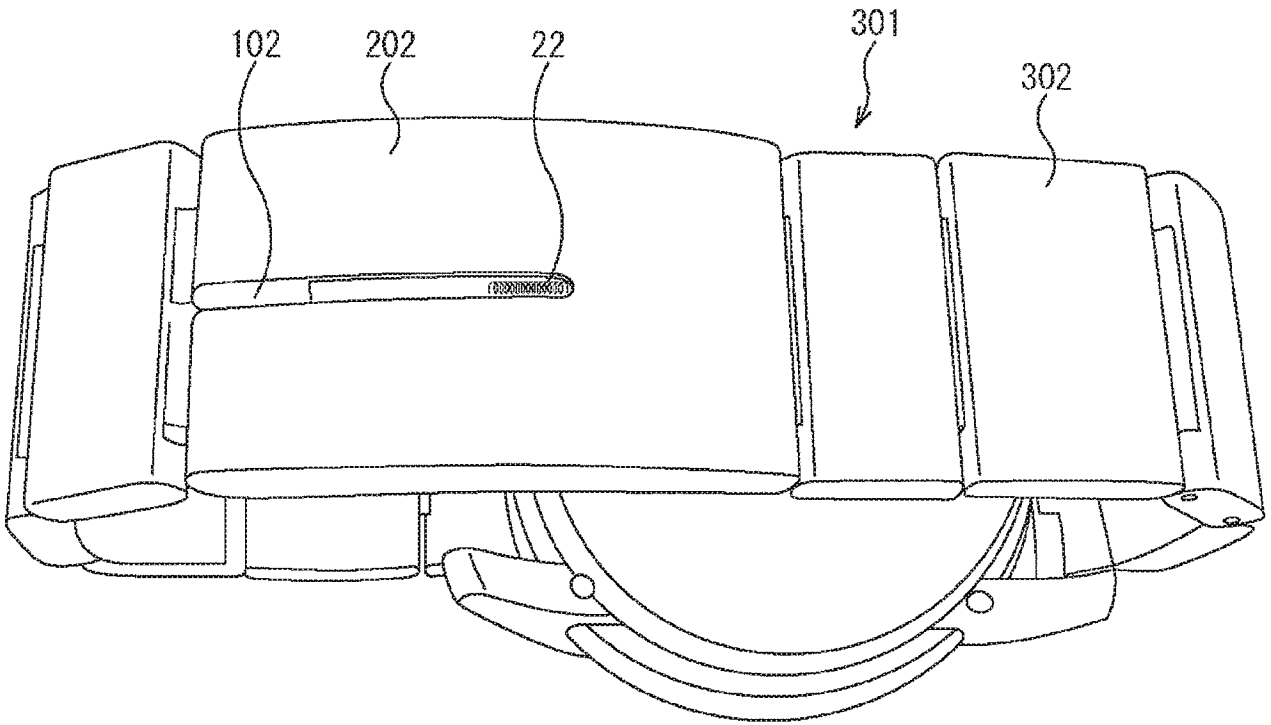
[FIG. 18]

[FIG. 19]
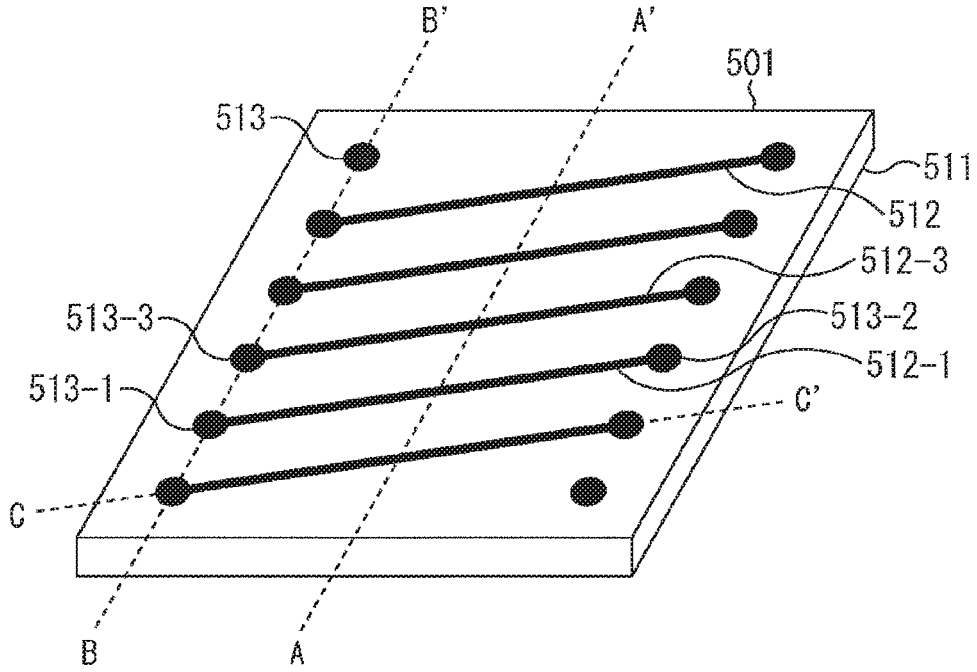

[FIG. 20A]
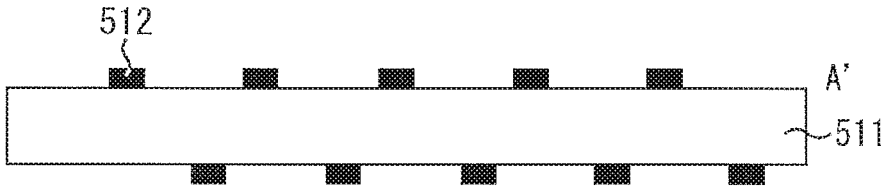
[FIG. 20B]
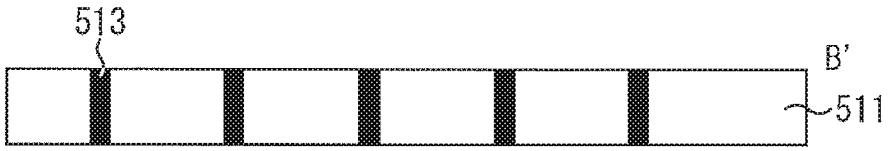
[FIG. 20C]
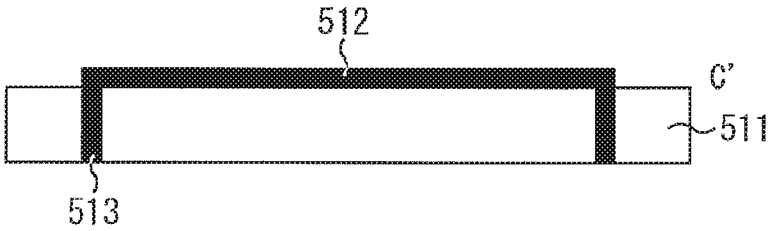

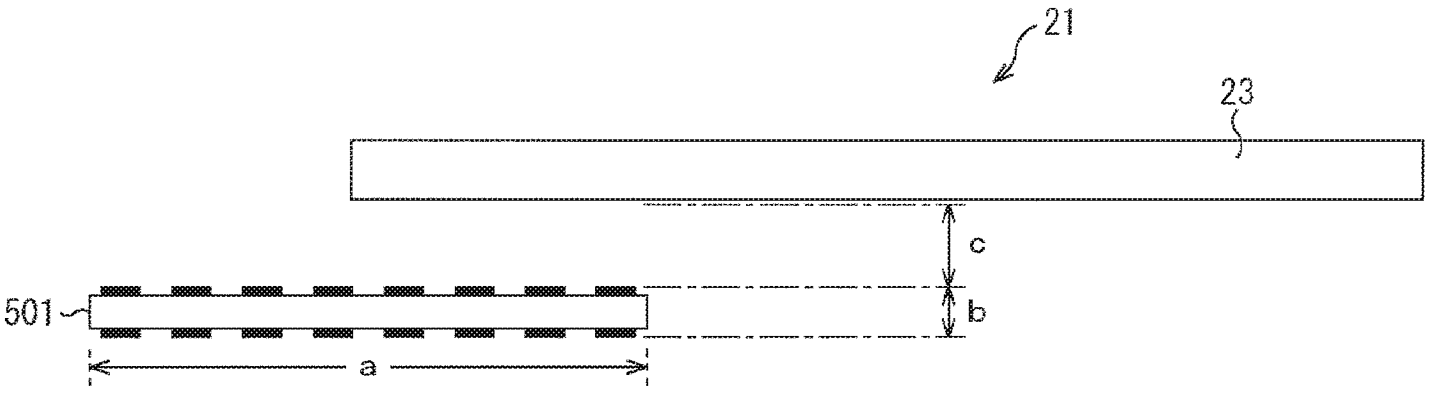
[FIG. 21]

[FIG. 22]
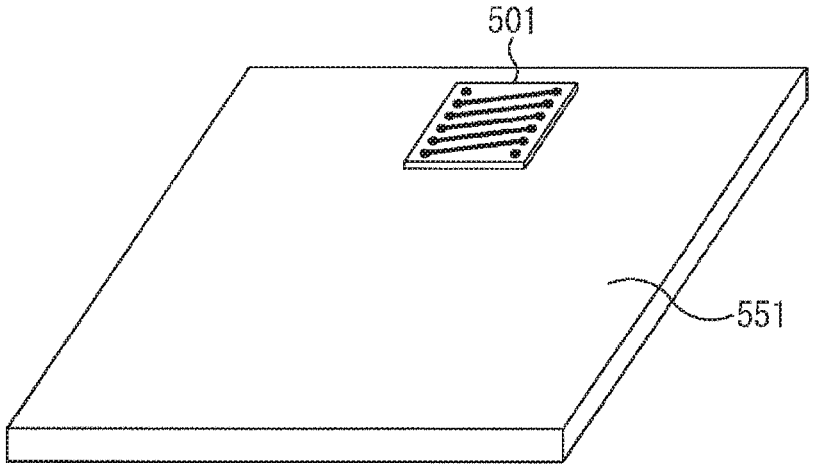

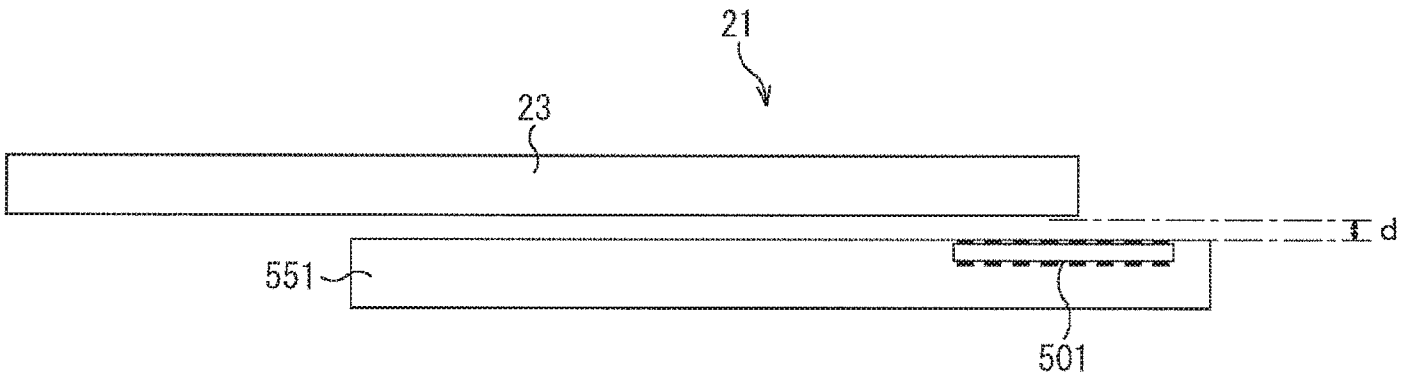
[FIG. 23]

[FIG. 24]
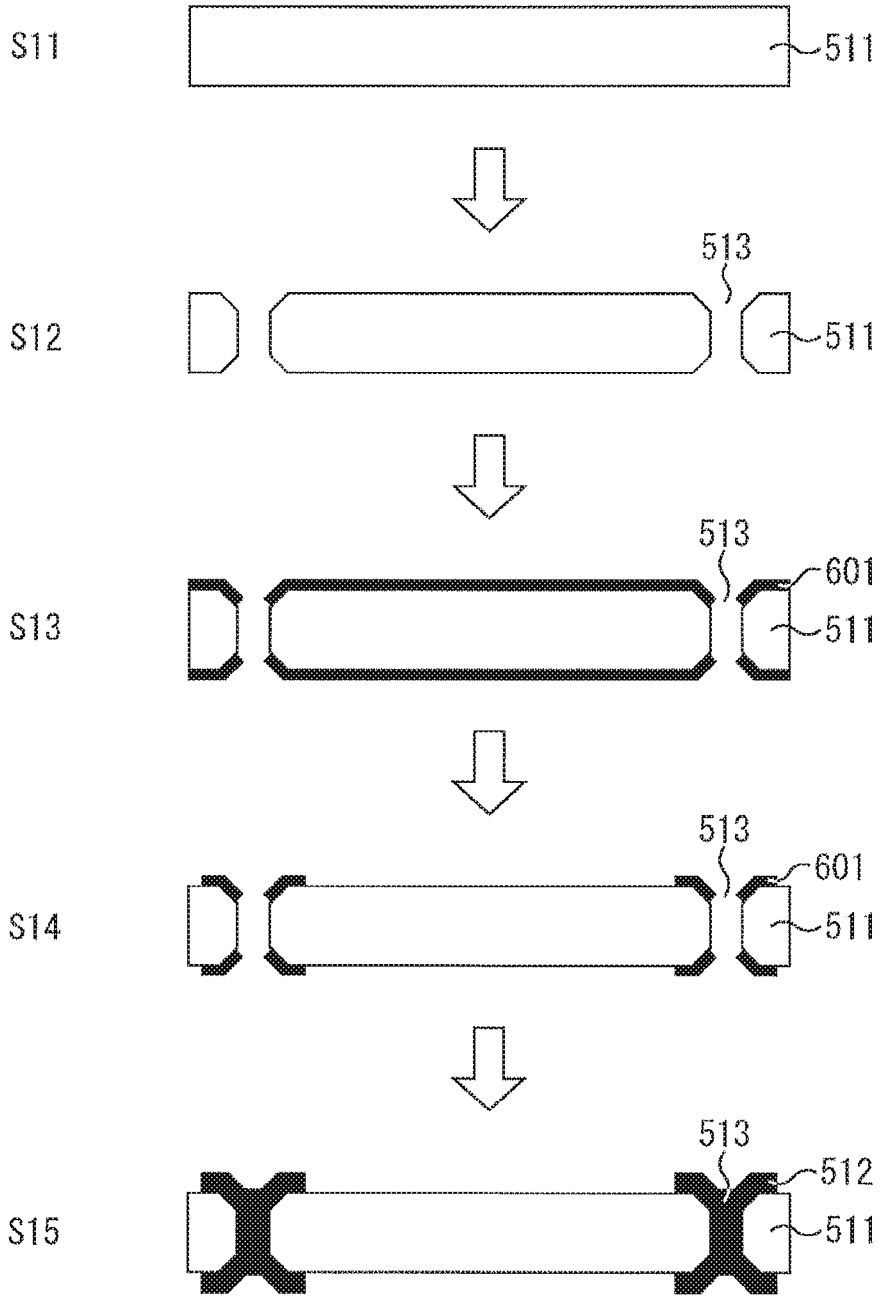

ANTENNA APPARATUS AND COMMUNICATION APPARATUS

CROSS REFERENCE TO RELATED APPLICATIONS

This application is a U.S. National Phase of International Patent Application No. PCT/JP2018/030724 filed on Aug. 21, 2018, which claims priority benefit of Japanese Patent Application No. JP 2017-169690 filed in the Japan Patent Office on Sep. 4, 2017. Each of the above-referenced applications is hereby incorporated herein by reference in its entirety.

TECHNICAL FIELD

The present technology relates to an antenna apparatus and a communication apparatus and relates to a communication apparatus that is used for wireless communication in a relatively short range, for example, NFC (Near field radio communication) RFID (Radio Frequency Identifier), wireless power feeding, and the like and an antenna apparatus suitable for application to the communication apparatus.

BACKGROUND ART

In recent years, various wireless transmission systems using wireless communication in a relatively short range such as a ticket gate in a station or a wireless tag (Tag) have been widely used. Communication by magnetic field coupling is used in such a wireless communication system; therefore, a planar spiral coil is normally incorporated as an antenna in a terminal device.

However, in order to stably perform communication with a communication partner, for example, a ticket gate machine and the like, it is necessary to strengthen coupling with a coil (an antenna) on a communication partner side. Therefore, there has been an issue that a spiral coil mounted on a terminal becomes larger and prevents miniaturization of a device.

To cope with this issue, for example, in PTL 1, it is proposed to miniaturize a planar spiral antenna and dispose a metal plate having a notch near the planar spiral antenna.

Furthermore, in PTL 2, a structure is proposed in which a solenoid antenna is sandwiched by metal plates and a slit is formed in a portion of the metal plate.

CITATION LIST

Patent Literature

PTL 1: Japanese Unexamined Patent Application Publication No. 2014-232904

PTL 2: Japanese Unexamined Patent Application Publication No. 2013-013149

SUMMARY OF THE INVENTION

Problems to be Solved by the Invention

Regarding the planar spiral antenna proposed in PTL 1, in order to radiate a magnetic field toward the coil (the antenna) on the communication partner side with a certain degree of intensity, it is necessary to have a certain area, for example, an area of about 14 mm×14 mm in PTL 1.

That is, miniaturization by using the planar spiral antenna has been limited. Furthermore, it has been necessary to provide a notch in the metal plate. Furthermore, PTL 1 indicates a result in which communication characteristics change on the basis of a condition of a combination of the planar spiral antenna and the metal plate having the notch. However, a behavior in a case where a shape of the antenna, or the like is changed is unknown, and there has been a possibility that communication performance is deteriorated depending on a combination of the shape of the antenna and the notch.

The metal plate proposed in PTL 2 is appropriately provided to shield an external magnetic field that enters the antenna. Accordingly, a radiation magnetic field from the antenna is weakened. Furthermore, complete shielding by the metal plate shields not only the external magnetic field but also a desired magnetic field; therefore, a slit is provided to avoid shielding of the desired magnetic field. Accordingly, in PTL 2, there has been a possibility that the communication performance is deteriorated.

It is desired to miniaturize an antenna without deteriorating communication performance. Furthermore, it is desired to further improve performance even in a case where the antenna is miniaturized.

The present technology has been devised in view of such circumstances, and is able to miniaturize an antenna without deteriorating communication performance and further improve performance even in a case where the antenna is miniaturized.

Means for Solving the Problems

An antenna apparatus according to one aspect of the present technology includes: a solenoid-coil-type solenoid antenna; and a metal plate disposed to have an overlapping portion with the solenoid antenna in a length direction of the solenoid antenna.

A communication apparatus according to one aspect of the present technology includes: a solenoid-coil-type solenoid antenna; and a metal plate disposed to have an overlapping portion with the solenoid antenna in a length direction of the solenoid antenna. The metal plate forms a portion of a housing. The housing contains the solenoid antenna. A portion of the solenoid antenna overlaps with the metal plate, and a remaining portion of the solenoid antenna is disposed in a slit portion.

The antenna apparatus according to the one aspect of the present technology includes at least the solenoid-coil-type solenoid antenna and the metal plate disposed to have the overlapping portion with the solenoid antenna in the length direction of the solenoid antenna.

The communication apparatus according to the one aspect of the present technology includes at least the solenoid-coil-type solenoid antenna and the metal plate disposed to have the overlapping portion with the solenoid antenna in the length direction of the solenoid antenna. The metal plate forms a portion of the housing. The housing contains the solenoid antenna. A portion of the solenoid antenna overlaps with the metal plate, and a remaining portion of the solenoid antenna is disposed in a slit portion.

Note that the antenna apparatus may be an independent apparatus or an internal block forming a single apparatus.

Note that the communication apparatus may be an independent apparatus or an internal block forming a single apparatus.

Effects of the Invention

According to one aspect of the present technology, it is possible to miniaturize an antenna without deteriorating communication performance and to further improve performance even if the antenna is miniaturized.

Note that effects described herein are not necessarily limited and may be any effect described in the present disclosure.

BRIEF DESCRIPTION OF DRAWING

FIG. 1 is a diagram illustrating a configuration of an embodiment of a system to which the present technology is applied.

FIG. 2 is a diagram illustrating a configuration of an embodiment of an antenna apparatus to which the present technology is applied.

FIG. 3 is a diagram for describing a configuration of a solenoid antenna.

FIGS. 4A and 4B are diagrams for describing an overlapping amount.

FIG. 5 is a diagram for describing the overlapping amount.

FIG. 6 is a diagram for describing a change in communication performance.

FIG. 7 is a diagram for describing a method of measuring the communication performance.

FIG. 8 is a diagram for describing an electromagnetic field to be generated.

FIG. 9 is a diagram for describing an electromagnetic field to be generated.

FIG. 10 is a diagram for describing an electromagnetic field to be generated.

FIG. 11 is a diagram for describing another configuration of a metal plate.

FIG. 12 is a diagram for describing still another configuration of the metal plate.

FIGS. 13A, 13B, and 13B are diagrams for describing a hole.

FIG. 14 is a diagram for describing yet another configuration of the metal plate.

FIG. 15 is a diagram for describing still yet another configuration of the metal plate.

FIG. 16 is a diagram for describing an electromagnetic field to be generated.

FIG. 17 is a diagram for describing still another configuration of the metal plate.

FIG. 18 is a diagram for describing a configuration in a case where the metal plate is configured as a housing.

FIG. 19 is a diagram for describing another configuration of the solenoid antenna.

FIGS. 20A, 20B, and 20C are cross-sectional diagrams for describing the configuration of the solenoid antenna.

FIG. 21 is a diagram for describing a positional relationship between the solenoid antenna and metal.

FIG. 22 is a diagram for describing a case where the solenoid antenna is integrated with a substrate.

FIG. 23 is a diagram for describing a positional relationship between the solenoid antenna and the metal.

FIG. 24 is a diagram for describing manufacture of the solenoid antenna.

MODES FOR CARRYING OUT THE INVENTION

A mode for carrying out the present technology (referred to as an embodiment below) will be described below.

<Configuration of Communication System>

FIG. 1 is a block diagram illustrating an embodiment of a configuration of a communication system 1 to which the present technology is applied.

The communication system 1 is a system that performs wireless communication in a relatively short range, for example, NFC (Near field radio communication), RFID (Radio Frequency Identifier), wireless power feeding, and the like.

The communication system 1 in FIG. 1 includes a reader/writer 11 and a mobile terminal apparatus 12. For example, the reader/writer 11 is provided as a portion of a configuration of a personal computer, and the mobile terminal apparatus 12 is a mobile phone having a wireless call function.

Alternatively, for example, the mobile terminal apparatus 12 is a wireless tag, and the reader/writer 11 is an apparatus that communicates with the wireless tag. Alternatively, for example, the mobile terminal apparatus 12 is a card-type communication apparatus that is used at the time of passing through a ticket gate in a station, and the reader/writer 11 is an apparatus that is installed in the ticket gate in the station and communicates with the card-type communication apparatus.

In this way, the reader/writer 11 and the mobile terminal apparatus 12 are apparatuses that wirelessly deliver and accept data and may have any form. For example, as described above, the mobile terminal apparatus 12 may be an apparatus such as a mobile phone, may be a card included in the mobile phone, may be a card-type communication apparatus that is used alone, may be a seal-like communication apparatus, or may be a communication apparatus that is incorporated in a wearable apparatus.

In the following, description will be continued with use of the mobile terminal apparatus 12 as an example. In the communication system 1, proximity communication is performed via a magnetic field generated from the reader/writer 11 by bringing the reader/writer 11 and the mobile terminal apparatus 12 closer to each other, for example, by holding the mobile terminal apparatus 12 over the reader/writer 11 by a user.

In the proximity communication, the reader/writer 11 transmits a predetermined command to the mobile terminal apparatus 12. The mobile terminal apparatus 12 receives the command transmitted from the reader/writer 11 and executes processing in accordance with the command or transmits a response command relative to the received command to the mobile terminal apparatus 12.

<Configuration of Antenna Apparatus>

The reader/writer 11 and the mobile terminal apparatus 12 wirelessly communicate with each other; therefore, each of the reader/writer 11 and the mobile terminal apparatus 12 includes an antenna apparatus. Here, the antenna apparatus included in the mobile terminal apparatus 12 will be further described.

FIG. 2 is a diagram illustrating a configuration of an embodiment of an antenna apparatus to which the present technology is applied. An antenna apparatus 21 includes a solenoid antenna 22 and a metal plate 23.

The solenoid antenna 22 has a configuration in which a wire is wound in a cylindrical shape as illustrated in FIG. 3. Furthermore, a winding direction in the solenoid antenna 22 is disposed to be parallel to a surface on which a coil on a communication partner side (an antenna, for example, an antenna 51 illustrated in FIG. 7) is disposed. That is, the winding direction in the solenoid antenna 22 is disposed at ±90 degrees relative to a formed angle of zero degrees.

In the following description, a length of the solenoid antenna 22 is a length a, and a diameter is a diameter b (a width is a width b). As an example, the solenoid antenna 22 has the length a=10 mm and the diameter b=1 mm. In the following description, a result of a simulation and the like will be described, and description will be continued on the assumption that the simulation is a simulation in a case where the solenoid antenna 22 having the above size is used.

The solenoid antenna 22 having a cylindrical shape is illustrated in FIG. 3. However, for example, the solenoid antenna 22 may have a rectangular shape or may be wound around a core. The core may be a dielectric material or a magnetic material.

In this way, it is possible to appropriately change the shape of the solenoid antenna 22, and it is also possible to appropriately change the size of the solenoid antenna 22 depending on a shape and a size of a product on which the antenna apparatus 21 is mounted, communication performance desired for the antenna apparatus 21, and the like.

As described later with reference to the simulation result and the like, according to the antenna apparatus 21 to which the present technology is applied, it is possible to improve the communication performance even in a case where the solenoid antenna 22 has a relatively small size of about 10 mm×1 mm as described above. For example, it is necessary for a planar spiral antenna to have a size of about 14 mm×14 mm. However, according to the present technology, it is possible to miniaturize the antenna to be smaller than the planar spiral antenna.

In a case where the solenoid antenna 22 is used, the solenoid antenna 22 is basically disposed to cause the winding direction of the solenoid antenna 22 to be parallel to the surface on which the coil (the antenna) on the communication partner side (for example, the reader/writer 11) is disposed. Unlike the planar spiral antenna in which a coil is formed in a surface direction on a concentric circle, it is possible to make a size of an occupied area of the solenoid antenna 22 extremely small.

In order to have communication performance equal to that of the planar spiral antenna or improve communication performance even in a case where such a miniaturizable solenoid antenna 22 is used, the metal plate 23 is disposed to cover a portion of the solenoid antenna 22 as illustrated in FIG. 2 in the antenna apparatus 21 to which the present technology is applied. The metal plate 23 is disposed on a surface on the communication partner side of the solenoid antenna 22.

Using the solenoid antenna 22 as the antenna apparatus 21 makes it possible to make the occupied area smaller than that of the planar spiral antenna. However, regarding a radiation direction of the magnetic field, the planar spiral antenna performs radiation toward the coil (the antenna) on the communication partner side. In contrast, the solenoid antenna 22 performs radiation to a direction orthogonal to the coil (the antenna) on the communication partner side.

Accordingly, there is a possibility that a magnetic field coupling strength with the coil (the antenna) on the communication partner side, that is, the communication performance is deteriorated. However, disposing the metal plate 23 to cover a portion of (to be positioned near) the solenoid antenna 22 as illustrated in FIG. 2 makes it possible to miniaturize the antenna apparatus 21 without deteriorating the magnetic field coupling strength with the coil (the antenna) on the communication partner side, that is, without deteriorating the communication performance.

Referring to FIG. 2 again, the antenna apparatus 21 has a configuration in which the metal plate 23 is disposed above the solenoid antenna 22 with a predetermined interval. Between the solenoid antenna 22 and the metal plate 23, for example, a space of about one mm is provided. That is, the solenoid antenna 22 and the metal plate 23 are disposed in a non-contact state.

For example, it is possible that the size of the disposed metal plate 23 is, for example, the length=about 50 mm, the width of about 25 mm, and the thickness=about 0.1 mm. Note that the size of the metal plate 23 is exemplary and does not indicate limitation, and other size may be naturally used. As illustrated in FIG. 2, it is possible to use a rectangular plate-like metal plate 23 having no notch.

The metal plate 23 is disposed to cover a portion of the solenoid antenna 22, and it is possible to adjust the communication performance by a size (a length) of the covered portion. An amount of the solenoid antenna 22 covered with the metal plate 23 (an overlapping amount of the metal plate 23 and the solenoid antenna 22) is represented by a rate relative to the length of the solenoid antenna 22 and is defined as in FIGS. 4A and 4B.

FIGS. 4A and 4B are diagrams illustrating a relationship between the solenoid antenna 22 and the metal plate 23 as viewed from a side of the solenoid antenna 22, in other words, as viewed from a side opposite to the communication partner side.

Referring to FIGS. 4A and 4B, a position at one end of the solenoid antenna 22 is a position PO and a position at another end is a position P1. In FIGS. 4A and 4B, a right side in the figure is the position PO and a left side in the figure is the position P1. A length from the position PO to the position P1 corresponds to the length a illustrated in FIG. 3.

As illustrated in FIG. 4A, a state where one side of the metal plate 23 overlaps with a side at the position PO of the solenoid antenna 22, in other words, a state where the solenoid antenna 22 does not overlap with the metal plate 23 and a state where the metal plate 23 is provided to a boundary portion with the solenoid antenna 22 indicates that an overlapping amount is 0%. Note that, in FIGS. 4A and 4B, for description, the position PO (P1) and the one side of the metal plate 23 are slightly separated in the illustration.

As illustrated in FIG. 4B, a state where the one side of the metal plate 23 overlaps with the side at the position P1 of the solenoid antenna 22, in other words, a state where the solenoid antenna 22 is completely covered with the metal plate 23 and a state where the metal plate 23 is provided to the boundary portion with the solenoid antenna 22 indicates that the overlapping amount is 100%.

Furthermore, for example, as illustrated in FIG. 5, an overlapping amount of 50% indicates a state where the solenoid antenna 22 is covered with the metal plate 23 to a position at a half of the length a. Although not illustrated, in a case where the metal plate 23 is positioned on the right side in the figure of the position P0 of the solenoid antenna 22, the overlapping amount is represented by a minus percentage, and in a case where the metal plate 23 is positioned on the left side in the figure of the position P1 of the solenoid antenna 22, the overlapping amount is indicated by a percentage equal to or more than 100%.

FIG. 6 is a diagram illustrating a result obtained by measuring communication performance upon changing the overlapping amount. In a graph illustrated in FIG. 6, a horizontal axis indicates an offset amount, and a vertical axis indicates a voltage value obtained on the communication partner side. The offset amount represents the overlapping amount described above.

The graph illustrated in FIG. 6 indicates the result obtained in a state illustrated in FIG. 7. Referring to FIG. 7, the antenna 51 of an apparatus serving as a communication partner is disposed on an upper side of the antenna apparatus 21 (the metal plate 23 above the solenoid antenna 22). The antenna 51 is a planar spiral antenna having a diameter of 70 mm and is coupled to a 1 k Ω voltage monitor 52 for measuring a voltage. Furthermore, a constant voltage of 13.56 MHz having a voltage of 1 V is supplied to the solenoid antenna 22.

The size of the solenoid antenna 22 is the size described with reference to FIG. 3, and the length a is 10 mm. In FIG. 6, the overlapping amount is zero at an offset of 0%, which indicates a state where the metal plate 23 does not overlap with the solenoid antenna 22. Furthermore, in FIG. 6, the overlapping amount is 100% at an offset of 100%, which indicates a state where the solenoid antenna 22 is completely covered with the metal plate 23.

Furthermore, in FIG. 6, the overlapping amount is 50% at an offset of 50%, which indicates a state where a half of the solenoid antenna 22 is covered with the metal plate 23.

In a case where a voltage value obtained on the side of the antenna 51 serving as the communication partner (a measurement value measured by the voltage monitor 52) when a voltage of 1 V is applied to the solenoid antenna 22 in the state illustrated in FIG. 7 is expressed as a graph, the graph illustrated in FIG. 6 is obtained.

Note that the graph illustrated in FIG. 6 indicates a result of the measurement in a state where the solenoid antenna 22 is separated from the antenna 51 by a predetermined distance, and in a case where the distance is changed, another measurement value is obtained. However, it goes without saying that characteristics (the shape of the graph) have substantially the same shape regardless of the distance and the measurement value illustrated in FIG. 6 is exemplary.

Referring to the graph illustrated in FIG. 6, it can be seen that a voltage that is receivable on the communication partner side is gradually increased when the overlapping amount of the metal plate 23 and the solenoid antenna 22 changes from 0% to 50%. Furthermore, it can be seen that a maximum voltage that is receivable on the communication partner side is obtained within a range of the overlapping amount from about 50% to about 80%. Furthermore, it can be seen that it is possible for the communication partner side to receive a relatively high voltage value even in a case where the overlapping amount is equal to or more than 80%.

Although not illustrated, in a state where the metal plate 23 is not provided that is a state similar to the state illustrated in FIG. 7, in other words, in a case where only the solenoid antenna 22 performs communication, the measurement value measured by the voltage monitor 52 of the antenna 51 is 0.004 mV. Referring to FIG. 6, for example, even in a case where the offset is −50%, the measurement value is about 0.2 mV. It can be seen that the communication performance is improved only by providing the metal plate 23 near the solenoid antenna 22.

In this way, it is possible to improve the communication performance by combining the metal plate 23 with the solenoid antenna 22. Furthermore, it can be seen from the result in FIG. 6 that the communication performance changes when the overlapping amount (the offset) of the metal plate 23 and the solenoid antenna 22 is changed. Accordingly, it is found that it is possible to adjust the communication performance by changing the overlapping amount (the offset) of the metal plate 23 and the solenoid antenna 22.

Setting the overlapping amount of the metal plate 23 and the solenoid antenna 22 to be about 50% to about 80% makes it possible to obtain the strongest coupling with the antenna 51 (the coil) on the communication partner side. Furthermore, it is possible to strengthen the coupling with the antenna 51 (the coil) on the communication partner side only by disposing the metal plate 23 near the solenoid antenna 22. It is possible to obtain an effect that the communication performance is improved even in a case where the overlapping amount of the metal plate 23 and the solenoid antenna 22 is 0% to 100%.

According to the present technology, it is possible to improve the communication performance as described above. Furthermore, it is possible to adjust the communication performance, which makes it possible to obtain desired performance.

The improvement in the communication performance by disposing the metal plate 23 and the solenoid antenna 22 to be partially overlapped with each other in this way will be further described.

FIGS. 8 and 9 are diagrams illustrating a simulation result of an electromagnetic field to be generated by the solenoid antenna 22. FIG. 8 illustrates an electromagnetic field generated by the solenoid antenna 22 on which the metal plate 23 is not disposed, and FIG. 9 illustrates an electromagnetic field generated by the solenoid antenna 22 on which the metal plate 23 is disposed. Furthermore, in FIGS. 8 and 9, the antenna 51 serving as a communication partner is illustrated above the solenoid antenna 22, and an electromagnetic field around the antenna 51 is also illustrated.

Referring to FIG. 8, the electromagnetic field by the solenoid antenna 22 is directed from one end (on a left side in FIG. 8) of the solenoid antenna 22 to another end (on a right side in FIG. 8). As indicated by large arrows in the figure, while the antenna 51 receives an upward electromagnetic field from the solenoid antenna 22 on the left side in the figure, the antenna 51 receives a downward electromagnetic field from the solenoid antenna 22 on the right side in the figure.

The antenna 51 serving as the communication partner of the solenoid antenna 22 receives the electromagnetic fields in different directions, and the electromagnetic fields cancel each other out. This weakens the coupling between the solenoid antenna 22 and the antenna 51.

In contrast, referring to FIG. 9, in a case where the metal plate 23 is disposed between the solenoid antenna 22 and the antenna 51 serving as the communication partner of the solenoid antenna 22 and the metal plate 23 is overlapped with the solenoid antenna 22 in a state where the overlapping amount is 50%, the antenna 51 receives the upward electromagnetic fields from the solenoid antenna 22 and the metal plate 23 as indicated by large arrows in the figure.

That is, by disposing the metal plate 23, the electromagnetic field generated by the solenoid antenna 22 is directed from the one end (on a left side in FIG. 9) of the solenoid antenna 22 toward the other end (on a right side in FIG. 9). A portion of the antenna 51, which receives the downward electromagnetic field when the metal plate 23 is not disposed, receives the upward electromagnetic field by disposing the metal plate 23.

This will be described with reference to FIG. 10. When a current flows into the solenoid antenna 22 at a time T1, a magnetic field (referred to as a magnetic field T2) from the position P1 toward the position P0 is generated at a time T2. For description, the solenoid antenna 22 is illustrated above the metal plate 23 in FIG. 10. However, a side of the position P0 of the solenoid antenna 22 is covered with the metal plate 23. Accordingly, the magnetic field T2 is shielded by the metal plate 23 before entering the side of the position P0 of the solenoid antenna 22.

In other words, a downward magnetic field enters the metal plate 23. When the downward magnetic field enters the metal plate 23 at a time T3, an eddy current (referred to as an eddy current T3) is generated on the surface of the metal plate 23. The generation of the eddy current T3 generates an upward magnetic field (referred to as a magnetic field T4) from the surface of the metal plate 23 at a time T4.

In this way, when the downward magnetic field T2 enters the side of the position P0 of the solenoid antenna 22, the magnetic field T4 is generated in a direction to cancel out the downward magnetic field T2, that is, an upward direction.

Accordingly, as illustrated in FIG. 9, the antenna 51 serving as the communication partner receives the upward magnetic field from the solenoid antenna 22 and also receives the upward magnetic field from the metal plate 23. In this way, the antenna 51 receives only the upward magnetic fields, and a situation in which the magnetic fields cancel each other out as described with reference to FIG. 8 does not occur.

Thus, disposing the metal plate 23 to cover a portion of the solenoid antenna 22 makes it possible to make the magnetic field wider, to strengthen the coupling with the communication partner, and to improve the communication performance.

<Another Shape of Metal Plate>

In FIG. 11, another shape of the metal plate 23 is illustrated. A slit 102 is formed in a metal plate 101 illustrated in FIG. 11. For comparison, referring to the metal plate 23 illustrated in FIG. 2 again, the metal plate 23 illustrated in FIG. 2 has a rectangular shape, and an opening portion such as a slit is not formed in the metal plate 23. In contrast, although the metal plate 101 illustrated in FIG. 11 has a rectangular shape, the slit 102 is formed in a portion of the metal plate 101.

The solenoid antenna 22 is disposed in parallel to a portion corresponding to the slit 102 (an opening portion of the metal plate 101). In a state where a portion of the solenoid antenna 22 is viewed through the slit 102 as viewed from a side of the metal plate 101, the metal plate 101 is disposed above the solenoid antenna 22. That is, similarly to the metal plate 23 described above, the metal plate 101 and the solenoid antenna 22 are disposed with a predetermined overlapping amount.

For example, it is possible to set the overlapping amount to 50%. In a case where the overlapping amount is 50%, a half of the solenoid antenna 22 overlaps with the metal plate 101, and the other half appears from the slit 102.

In this way, regarding the metal plate 101 in which the slit 102 is provided, it is possible to set an overlapping state of the metal plate 101 and the solenoid antenna 22 to be similar to that of the metal plate 23. Therefore, description thereof is omitted.

As in a case of the metal plate 23 described above, it is possible to obtain the strongest coupling with the communication partner in a case where the overlapping amount of the metal plate 101 and the solenoid antenna 22 is about 50% to about 80%. Furthermore, even in a case where the overlapping amount of the metal plate 101 and the solenoid antenna 22 is within a range of 0% to 100%, an effect obtained by providing the metal plate 101 is obtained, and it is possible to strengthen the coupling with the communication partner as compared with a case where the metal plate 101 is not provided.

In a case where the slit 102 is provided as in the metal plate 101, a size of the slit 102 is formed to be larger than that of the solenoid antenna 22. That is, as illustrated in FIG. 11, a width b' of the slit 102 is formed to be wider than the diameter b of the solenoid antenna 22 (FIG. 3).

For example, the width b' of the slit 102 is formed to be about 165% (about 1.65 times) of the diameter b of the solenoid antenna 22 (a length corresponding to the diameter in a case where the solenoid antenna 22 has a circular shape). For example, in a case where the diameter b of the solenoid antenna 22 is the width b=1 mm, it is possible to form the width b' of the slit 102 to be about the width b'=1.65 mm.

Note that, even in a case where the width b' of the slit 102 is formed to be a size of about 100% of the diameter b of the solenoid antenna 22, in other words, even in a case where the width b' of the slit 102 is formed to be substantially the same (about one time) as the diameter b of the solenoid antenna 22, an opening portion through which the magnetic field generated by the solenoid antenna 22 is released is provided, which makes it possible to improve the communication performance as in a case of the metal plate 23 described above.

Moreover, the applicant has confirmed that forming the width b' of the slit 102 to be equal to or wider than 165% of the diameter a of the solenoid antenna 22 makes it possible to further improve the communication performance as compared with a case where the width b' is about 100%. Here, as an example, a numerical value of 165% is indicated.

Furthermore, according to the metal plate 101 in which the slit 102 is formed, it is possible to adjust the communication performance by adjusting not only the overlapping amount of the metal plate 101 and the solenoid antenna 22 but also the width b' of the slit 102.

As in a case of the metal plate 23 described above, even in the metal plate 101, it is possible to adjust the communication performance by adjusting the overlapping amount of the metal plate 101 and the solenoid antenna 22. Moreover, in a case of the metal plate 101, it is possible to adjust the communication performance by forming the width b' of the slit 102 to be equal to or wider than 0% of the diameter b of the solenoid antenna 22 or adjusting a percentage (%) thereof.

The diameter b of the solenoid antenna 22 is 0% in a case where the width b' of the slit 102 is the width b'=0 mm. If the width b' is formed to be wider than 0 mm, that is, if the slit 102 is formed only slightly, the magnetic field is radiated from the slit 102. This makes it possible to further improve the communication performance as compared with a case where the metal plate is not provided.

Furthermore, even in a case where the width b' is formed to be 0% of the diameter b of the solenoid antenna 22 (the width b' of the slit 102 is the width b'=0 mm), the metal plate 101 having no slit 102 is formed, that is, the metal plate 101 has the same shape as the metal plate 23, and even in a state where the metal plate 23 completely covers the solenoid antenna 22 (the overlapping amount=100%), the communication performance is improved as compared with a case where the metal plate is not provided. This has already been described.

Accordingly, it is possible to adjust the communication performance by adjusting the width of the slit 102 or adjusting the overlapping amount of the metal plate 101 and the solenoid antenna 22, and it is possible to configure the antenna apparatus 21 having desired communication performance.

<Still Another Shape of Metal Plate>

The metal plate 23 and the metal plate 101 have been described as a metal plate disposed above the solenoid antenna 22 (on the communication partner side).

Moreover, as illustrated in FIG. 12, a metal plate may be disposed below the solenoid antenna 22. Furthermore, as illustrated in FIG. 12, the metal plate may be formed as a metal plate surrounding the solenoid antenna 22. FIG. 12 is a diagram of the solenoid antenna 22 viewed from a side surface.

In a metal plate 201 illustrated in FIG. 12, a metal plate 201*a* is disposed above the solenoid antenna 22 (on an upper side in the figure and a side where the communication partner side is positioned), and a metal plate 201*b* is disposed below the solenoid antenna 22. The metal plate 201*a* is formed to overlap with the solenoid antenna 22 at a predetermined rate of the overlapping amount. The metal plate 201*b* covers an entire solenoid antenna 22.

A case is illustrated where a hole 221 is formed between the metal plate 201*a* and the metal plate 201*b* of the metal plate 201 illustrated in FIG. 12. In FIG. 12, an example is illustrated in which the hole 221 is formed in a portion close to a right end in the figure of the metal plate 201*b* on a lower side of the metal plate 201.

Forming the hole 221 makes it possible to provide a configuration in which a magnetic field outputted from the one end of the solenoid antenna 22 to an underside direction returns to the other end of the solenoid antenna 22 from the hole 221 along the metal plate on the underside.

Furthermore, it is possible to provide a configuration in which a magnetic field outputted to an upper side of the solenoid antenna 22 returns to the solenoid antenna 22 from the hole 221 along the metal plate 201*a*.

Note that, in FIG. 12, it is illustrated as if the metal plate 201 is separated into the metal plate 201*a* and the metal plate 201*b* at around the hole 221. However, as illustrated in FIGS. 13A, 13B, and 13C, for example, a rectangular or circular hole is formed in a portion of the metal plate 201*b*. FIGS. 13A, 13B, and 13C are diagrams of a metal plate 2-1*b* viewed from below.

As illustrated in A of FIG. 13A, it is possible for the hole 221 to have a rectangular shape. In FIG. 13A, a rectangular shape is illustrated, but a shape such as a square or a polygon may be used. Furthermore, in a case where a rectangular hole 221 is formed as illustrated in FIG. 13A, it is possible to set a length of a longer side to be a length f. Furthermore, the hole 221 is formed at a position where a portion of the solenoid antenna 22 is viewed from the hole 221 formed in a rectangular shape if the antenna apparatus 21 is viewed from below (from a side of the metal plate 201*b*). Furthermore, the slit 102 is formed at a position indicated by a dotted line in FIG. 13A.

As illustrated in FIG. 13B, a circular hole 221 may be formed. In FIG. 13B, a circular shape is illustrated, but shape such as an elliptical shape may be used. Furthermore, as illustrated in FIG. 13B, in a case where the circular hole 221 is formed, it is possible to set a diameter of the hole 221 to be the length f. In a case where the elliptical hole 221 is formed, it is possible to set a length of a major axis (or a minor axis) to be the length f. Even in a case of the circular shape, the hole 221 is formed at a position where a portion of the solenoid antenna 22 is viewed from the hole 221 formed in a circular shape if the antenna apparatus 21 is viewed from below. Furthermore, the slit 102 is formed at a position indicated by a dotted line in FIG. 13B.

As illustrated in C of FIG. 13C, a plurality of rectangles may form the hole 221. In FIG. 13C, a case is illustrated where a plurality of rectangular holes forms the hole 221, but the hole 221 may be formed by a plurality of circular, elliptical, or square holes. Furthermore, the hole 221 may be formed by a plurality of holes having different shapes. For example, a plurality of circular holes and a plurality of rectangular holes may be formed, and these plurality of poles may form the hole 221.

Even in a case of the hole 221 illustrated in FIG. 13C, the hole 221 is formed at a position where a portion of the solenoid antenna 22 is viewed from the hole 221 formed by the plurality of holes if the antenna apparatus 21 is viewed from below. Furthermore, the slit 102 is formed at a position indicated by a dotted line in FIG. 13C.

As illustrated in FIGS. 13A, 13B, and 13C, the hole 221 and the slit 102 are formed at positions where the hole 221 and the slit 102 do not overlap with each other.

The shape and the size of the hole 221 described here are exemplary and are not limited to the above description. Furthermore, the shape and the size of the hole 221 are appropriately set on the basis of a shape of a product in which the solenoid antenna 22 is disposed, for example, a shape of a belt of a watch to be described later, and the like. Furthermore, at the time of the setting, the shape and the size may be set in consideration of the size of the solenoid antenna 22.

As illustrated in FIG. 14, the size of the hole 221 may be formed to have the width f. The width f of the hole 221 illustrated in FIG. 14 is wider than the width f illustrated in FIG. 12. Furthermore, one end of the width d is a position P11 that is substantially the same as one end of the slit 102.

The shape of the metal plate 201 is not limited to the shapes illustrated in FIGS. 12 and 14 and may be, for example, a shape illustrated in FIG. 15. In the metal plate 201 illustrated in FIG. 15, the metal plate 201*b* formed on a lower side is formed in an L-like shape. The antenna apparatus 21 illustrated in FIG. 15 includes L-shaped metal plates 201 above and below the solenoid antenna 22.

In FIG. 15, a case is illustrated where the L-shaped metal plate 201 is applied to the antenna apparatus 21 illustrated in FIG. 14. However, it is possible to include the L-shaped metal plate 201 in the antenna apparatus 21 illustrated in FIG. 12.

The metal plate 201*b* provided on the lower side has an L-like shape, and the direction of the magnetic field outputted from one end (a left end in FIG. 15) of the solenoid antenna 22 to an upward direction by the L-shaped metal plate 201*b*, which makes it possible to generate more upward magnetic fields.

In a case of the metal plate 201 illustrated in FIG. 15, the metal plate 201 is formed in a shape such as a rectangular parallelepiped or a cylinder, the slit 102 is formed in an upper surface of the metal plate 201, and the hole 221 is formed in a rear surface. Then, the solenoid antenna 22 is disposed in the metal plate 201.

In a case where the metal plate 201 in which such a hole 221 is formed, here, the metal plate 201 illustrated in FIG. 12 is disposed around the solenoid antenna 22, an electromagnetic field is generated as illustrated in FIG. 16. Referring to FIG. 16, in a case where the metal plate 201 is disposed between the solenoid antenna 22 and the antenna 51 serving as a communication partner and the metal plate 201 overlaps with the solenoid antenna 22 with an overlapping amount of 50%, the antenna 51 receives upward electromagnetic fields from the solenoid antenna 22 and the metal plate 201 as indicated by large arrows in the figure.

This is similar to a case described with reference to FIG. 9 (similar to a case of the metal plate 23). Accordingly, as in a case described above, even in a case of the metal plate 201 illustrated in FIGS. 12, 13A, 13B, 13C, 14, and 15 it is possible to make the magnetic field from the solenoid antenna 22 wider, to strengthen the coupling with the communication partner, and to improve the communication performance.

Furthermore, the metal plate 201 has the hole 221 in a lower portion; therefore, it is possible for the metal plate 201 to receive the returned magnetic field from the hole 221. For example, a portion of the magnetic field generated upward from the solenoid antenna 22 moves to the hole 221 along the metal plate 201*a* and returns into the metal plate 201 from the hole 221. In this way, forming the hole 221 makes it possible to provide a configuration in which a magnetic field outputted from the one end of the solenoid antenna 22 to an underside direction returns to the other end of the solenoid antenna 22 from the hole 221 along the metal plate on the underside.

To have a structure in which the magnetic field returns to the solenoid antenna 22 in this way, it is sufficient if the hole 211 is provided on a lower side of the solenoid antenna 22 as illustrated in FIGS. 12 and 14, in other words, a side opposite to a side where the communication partner side is positioned, in still other words, a side opposite to a side where the slit 102 is formed.

Furthermore, as illustrated in FIG. 17, the hole 211 may be formed on a side surface of the metal plate 201. In a case where the hole 221 is formed on the side surface of the metal plate 201, the hole 221 is formed below the center of the solenoid antenna 22.

As illustrated in FIG. 17, a position of the upper surface of the metal plate 201 is a position P21 (in a case where a thickness of the metal plate 201 is considered, a position at a half of the thickness), a position of the lower surface of the metal plate 201 is a position P22, and a height between the position P21 and the position P22 is a height h1. Furthermore, a position of a center core of the solenoid antenna 22 is a position P31 and a height between the position P21 of the upper surface of the metal plate 201 and the position P31 is a height h2.

In a case where the hole 211 is formed in the side surface of the metal plate 201, the hole 211 is formed below a position P32 of the center core of the solenoid antenna 22. As described above, the hole 211 is provided to absorb the return of the magnetic field generated from the solenoid antenna 22; therefore, the hole 211 is formed below the center core of the solenoid antenna 22.

In this way, the hole 211 may be formed in the side surface of the metal plate 201 and below the center core of the solenoid antenna 22 (a lower side in a case where a side where the communication partner is positioned is an upper side).

In FIG. 17, the metal plate 201*b* that does not have an L-like shape is illustrated. However, the L-shaped metal plate 201*b* as illustrated in FIG. 15 may be applied.

The disposing position of the solenoid antenna 22 is preferably brought as close to the upper metal plate 201*a* as possible. In FIG. 17, a distance between the solenoid antenna 22 and the metal plate 201 is a distance g. The distance g is as small a distance as possible, but a distance that is large enough to prevent the solenoid antenna 22 and the metal plate 201 from coming into contact with each other.

If the distance g is increased, that is, the solenoid antenna 22 and the metal plate 201 are separated from each other, the magnetic field generated by the solenoid antenna 22 loops in the metal plate 201, and an amount of the magnetic field outputted to outside of the metal plate 201 is reduced.

Accordingly, the position of the solenoid antenna 22 is a position where the solenoid antenna 22 is not in contact with the metal plate 201. However, it is preferable to dispose the solenoid antenna 22 at a position that minimizes the distance between the solenoid antenna 22 and the metal plate 201. For example, it is possible to set a distance d between the solenoid antenna 22 and the metal plate 201 to be larger than 0% of the diameter b of the solenoid antenna 22 and equal to or smaller than 100% of the diameter b of the solenoid antenna 22.

This is similar to a case where the metal plate 23 is disposed above the solenoid antenna 22 described with reference to FIG. 2 and the like. The metal plate 23 and the solenoid antenna 22 are disposed at positions that is not in contact with each other but is as close to each other as possible.

As described above, for example, in a case where the metal plate 201 is formed as illustrated in FIG. 12, it is possible to use the metal plate 201 as a housing. For example, as illustrated in FIG. 18, it is possible to use the metal plate 201 to configure a portion of a belt of a watch.

The metal plate 201 is used as a portion of a belt 302 of a watch 301 illustrated in FIG. 18. In the metal plate 201, the slit 102 described with reference to FIG. 11 is formed. That is, the upper surface of the metal plate 201 has a similar configuration to the metal plate 101 in FIG. 11, and the slit 102 is formed in the upper surface of the metal plate 201.

The metal plate 201 configures a portion of the belt 302 and functions as a housing that contains the solenoid antenna 22. In other words, the solenoid antenna 22 is contained in a single housing configuring the belt 302, and the slit 102 is formed in a portion of the housing. In addition, for example, a portion corresponding to 50% of the contained solenoid antenna 22 is exposed from the slit 102.

In this way, it is possible to apply the metal plate that is used to improve the communication performance of the solenoid antenna 22 to a portion configuring a predetermined apparatus. In other words, it is possible for the communication apparatus including the antenna apparatus 21 to be included in a portion configuring a predetermined apparatus.

Furthermore, for example, as illustrated in FIG. 18, in a case where the metal plate 201 in which the slit 102 is formed is used as a portion of the belt 302 of the watch 301, a portion corresponding to the slit 102 may be covered with, for example, a substance, such as plastic, that does not shield the magnetic field.

In other words, it is possible to process the portion corresponding to the slit 102 by a substance that does not shield the magnetic field in order to prevent entrance of water, pride, and the like from the slit 102 to the inside. Furthermore, it is possible to use the portion of the slit 102 as a portion of design of the watch 301.

Here, the watch has been described as an example. However, an apparatus including the antenna apparatus 21 to which the present technology is applied may be a wearable apparatus other than the watch, the wireless tag, and the like as described above.

Furthermore, as the metal plate (the metal plate 23, the metal plate 101, or the metal plate 201), it is possible to use non-metal such as plastic or ceramics covered with metal, or non-metal such as plastic or ceramics in complex with metal.

Furthermore, the metal plate may be formed by using pure metal such as copper or iron, special steel such as SUS (stainless steel), an alloy, or the like.

According to the present technology, the solenoid antenna makes it possible to further improve communication characteristics while achieving significant miniaturization and reduction in the occupied area as compared with the planar spiral antenna.

<Another Shape of Solenoid Antenna>

The solenoid antenna 22 according to the above embodiment in which a wire is processed in a cylindrical shape as illustrated in FIG. 3 has been described as an example. Regardless of the shape described above, the present technology is applicable to any other shapes. Here, another shape of the solenoid antenna will be further described as an example.

FIG. 19 is a diagram illustrating another example of the solenoid antenna. A solenoid antenna 501 illustrated in FIG. 19 has a configuration in which linear metal (referred to as a metal wire 512 below) is formed on an upper surface and a lower surface of a magnetic substrate 511 such as ferrite, and the metal wires 512 formed on the upper surface and the lower surface are coupled by a via 513 that vertically penetrates through the substrate.

For example, a via 513-1 and a via 513-2 denoted with reference numerals in FIG. 19 are coupled by a metal wire 512-1. The via 513-2 and a via 513-3 are coupled by a metal wire 512-2 (not illustrated in FIG. 19) formed on the lower surface of the magnetic substrate 511. The via 513-3 is coupled to a metal wire 512-3.

Only the upper surface of the magnetic substrate 511 is illustrated in FIG. 19: therefore, the metal wires 512-1 and 512-3 are not coupled to each other in the illustration. However, the metal wires 512-1 and 512-3 are coupled by the metal wire 512-2 on the lower surface.

Thus, the metal wire 512 is formed in a spiral shape.

A cross-sectional diagram taken along a line segment A-A', a cross-sectional diagram taken along a line segment B-B', and a cross-sectional diagram taken along a segment C-C' of the solenoid antenna 501 illustrated in FIG. 19 are illustrated in FIGS. 20A, 20B, and 20C.

FIG. 20A is a cross-sectional diagram taken along the line segment A-A'. The line segment A-A' is a line segment that is vertically drawn in a substantially center portion of the magnetic substrate 511 in FIG. 19. The metal wires 512 are formed on both an upper surface and a lower surface of a cross section of the solenoid antenna 501 along the line segment A-A'. The metal wire 512 formed on the upper surface and the metal wire 512 formed on the lower surface are formed at positions different from each other.

FIG. 20B is a cross-sectional diagram taken along the line segment

B-B'. The line segment B-B' is a line segment that is vertically drawn in a portion where the via 513 is formed in the magnetic substrate 511 in FIG. 19. On a cross section of the solenoid antenna 501 along the segment B-B', the via 513 that penetrates through the magnetic substrate 511 is formed, and the inside of the via 513 is filled with metal. An upper portion of the via 513 is coupled to the metal wire 512 formed on the upper surface of the magnetic substrate 511, and a lower portion of the via 513 is coupled to the metal wire 512 formed on the lower surface of the magnetic substrate 511.

FIG. 20C is a cross-sectional diagram taken along the line segment C-C'. The line segment C-C' is a line segment that is drawn in a direction along the metal wire 512 formed on the upper surface of the magnetic substrate 511 in FIG. 19. On a cross section of the solenoid antenna 501 along the line segment C-C', the vias 513 are formed both on the left and right sides, and the metal wire 512 is formed to couple the vias 513 to each other.

In this way, the solenoid antenna 501 is formed by forming a plurality of linear wires 512 on the upper and lower surfaces of the magnetic substrate 511 and coupling the metal wires 512 by the vias 513.

In FIG. 19, although the shape of the magnetic substrate 511 is represented as a rectangular parallelepiped, the shape of the magnetic substrate 511 may be a cylindrical shape and the like. For example, in a case where the magnetic substrate 511 is formed in a cylindrical shape, the metal wires 512 are formed on a bottom surface and an upper surface of the cylindrical shape.

It is possible to use the solenoid antenna 501 instead of the solenoid antenna 22 described above (for example, illustrated in FIG. 2). That is, as illustrated in FIG. 21, it is possible for the antenna apparatus 21 to include the solenoid antenna 501 and the metal plate 23.

A winding direction in the solenoid antenna 501 is disposed to be parallel to a surface on which a coil on the communication partner side (an antenna, for example, the antenna 51 illustrated in FIG. 7) is disposed. That is, the winding direction in the solenoid antenna 501 is disposed at ±90 degrees relative to a formed angle of zero degrees.

As illustrated in FIG. 21, in a case where a length of the solenoid antenna 501 is a length a and the thickness is a thickness b, it is possible for the solenoid antenna 501 to have the length a=10 mm and the thickness b=1 mm as an example.

The size (the thickness b) of the solenoid antenna 501 depends on the thickness of the magnetic substrate 511. Forming the thin magnetic substrate 511 makes it possible to form the thin solenoid antenna 501. For example, in a case where the thickness of the magnetic substrate 511 is about 1 mm, the size (the thickness b) of the solenoid antenna 501 in the vertical direction is about 1 mm.

The solenoid antenna 501 includes the magnetic substrate 511 therein. Accordingly, in a case where the thickness of the magnetic substrate 511 is equal to or less than 1 mm, for example, 0.5 mm, the strength of the magnetic substrate 511 makes it possible to form the solenoid antenna 501 without collapsing the shape. In a case where the thickness of the magnetic substrate 511 is about 0.5 mm, the thickness b of the solenoid antenna 501 is also about 0.5 mm.

Referring to FIG. 21, the antenna apparatus 21 has a configuration in which the metal plate 23 is disposed above the solenoid antenna 501 with a predetermined interval. The disposing position of the solenoid antenna 501 is preferably brought as close to the upper metal plate 23 as possible. In FIG. 21, a distance between the solenoid antenna 501 and the metal plate 23 is a distance c. The distance c is set as small a distance as possible, but a distance that is large enough to prevent the solenoid antenna 501 and the metal plate 23 from coming into contact with each other.

For example, it is possible to set a distance d between the solenoid antenna 501 and the metal plate 23 to be larger than 0% of the thickness b of the solenoid antenna 501 and equal to or smaller than 200% of the thickness b of the solenoid antenna 501. Note that 0% represents a state where the solenoid antenna 501 and the metal plate 23 are in contact with each other.

For example, in a case where the thickness b of the solenoid antenna 501 is 0.5 mm and an interval c between the solenoid antenna 501 and the metal plate 23 is 1 mm, the distance c between the solenoid antenna 501 and the metal plate 23 is 200% of the thickness b of the solenoid antenna 501.

Even in a case where the solenoid antenna 501 is used, as in the solenoid antenna 22 (for example, illustrated in FIG.

2), the metal plate 23 is disposed to cover a portion of the solenoid antenna 501 as illustrated in FIG. 21. It is possible to adjust the communication performance by a size (a length) of the portion of the solenoid antenna 501 covered with the metal plate 23.

An amount of the solenoid antenna 501 covered with the metal plate 23 (an overlapping amount of the metal plate 23 and the solenoid antenna 501) is, for example, similar to that in a case of the solenoid antenna 22 described with reference to FIGS. 4A and 4B and the like.

As illustrated in FIG. 22, it is possible to form the solenoid antenna 501 to be embedded in or integrated with a substrate 551 such a circuit substrate, an ID substrate, or the like. The substrate 551 is a circuit substrate, an ID substrate, or the like, or is a silicon substrate, a ceramic substrate, an organic substrate, or the like.

The solenoid antenna 501 is formed to be integrated with such a substrate 551. Alternatively, the solenoid antenna 501 is embedded in such a substrate 551.

It is possible to form the solenoid antenna 501 to be thin as described above, it is possible to form the solenoid antenna 501 to be integrated with or embedded in the substrate 551 such as a circuit substrate.

Even in the solenoid antenna 501 integrated with the substrate 551 as illustrated in FIG. 22, in a case where the antenna apparatus 21 is configured to have the metal plate 23 disposed above as illustrated in FIG. 23, the substrate 551 and the metal plate 23 are disposed to be separated by the distance d.

Referring to FIG. 24, manufacture of the solenoid antenna 501 will be further described. In FIG. 24, a portion taken along the line segment B-B' in FIG. 19 that is a portion corresponding to the vias 513 is enlarged and illustrated.

In a process S11, the magnetic substrate 511 such as ferrite is prepared.

In a process S12, patterning is performed on the magnetic substrate 511 with use of a technique such as photolithography, and etching is performed with use of a technique such as RIE (Reactive Ion Etching) to form the vias 513.

In a process S13, metal 601 is deposited on the upper and the lower surfaces of the magnetic substrate 511 by a technique such as vapor deposition or sputtering.

In a process S14, patterning is performed on the deposited metal with use of a technique such as photolithography, and etching is performed on the deposited metal with use of a technique such as RIE (Reactive Ion Etching) or ion milling, thereby forming a pattern of the antenna (a portion forming the metal wires 512).

In a process S15, plating by an electric field or no electric field is performed, thereby filling the vias 513 with metal and coupling the vias to each other. Furthermore, metal is deposited on a patterned portion to form the metal wires 512. The portion taken along the line segment B-B' in FIG. 19 is illustrated in FIG. 24; therefore, the metal wires 512 between the vias 513 are disconnected. However, in a case where the portion taken along the line segment C-C' in FIG. 19 is illustrated, the metal wire 512 is formed as a single metal wire 512 that couples the vias 513 to each other, as illustrated in FIG. 20C.

The solenoid antenna 501 is formed through such processes.

According to the present technology, the solenoid antenna makes it possible to further improve communication characteristics while achieving significant miniaturization and reduction in the occupied area as compared with the planar spiral antenna.

A system herein represents an entire apparatus including a plurality of apparatuses.

It is to be noted that the effects described herein are merely illustrative and non-limiting, and other effects may be provided.

It is to be noted that an embodiment of the present technology is not limited to the embodiment described above, and may be modified in variety of ways in a scope without departing from the gist of the present technology.

Note that it is possible for the present technology to have the following configurations.

(1)

An antenna apparatus including:

a solenoid-coil-type solenoid antenna; and a metal plate disposed to have an overlapping portion with the solenoid antenna in a length direction of the solenoid antenna.

(2)

The antenna apparatus according to (1), in which the overlapping portion includes a portion corresponding to a length of 50% to 80% of a length of the solenoid antenna.

(3)

The antenna apparatus according to (1), in which the overlapping portion includes a portion corresponding to a length of 0% to 100% of a length of the solenoid antenna.

(4)

The antenna apparatus according to any one of (1) to (3), in which a slit is formed in the metal plate, and the solenoid antenna is disposed in parallel to the slit.

(5)

The antenna apparatus according to (4), in which the slit has a width that is formed to be equal to or more than one time of a width of the solenoid antenna.

(6)

The antenna apparatus according to (4), in which the metal plate has a hole formed on a side opposite to a side where the slit is formed.

(7)

The antenna apparatus according to (6), in which the hole is formed below a center core of the solenoid antenna.

(8)

The antenna apparatus according to (6), in which the slit and the hole do not overlap with each other.

(9)

The antenna apparatus according to any one of (1) to (8), in which the solenoid antenna is disposed at a position that is not in contact with the metal plate and maintains a shortest distance from the metal plate.

(10)

The antenna apparatus according to any one of (1) to (8), in which a distance between the solenoid antenna and the metal plate is larger than 0% and equal to or smaller than 100% of a diameter of the solenoid antenna.

(11)

The antenna apparatus according to any one of (1) to (10), in which the metal plate functions as a housing.

(12)

The antenna apparatus according to any one of (1) to (11), in which the metal plate includes non-metal covered with metal or non-metal in complex with metal.

(13)

The antenna apparatus according to any one of (1) to (12), in which the solenoid antenna includes a solenoid that includes a magnetic material as a core material and metal wound around the core material.

(14)

The antenna apparatus according to (1), in which the solenoid antenna includes metal wires linearly formed on an upper surface and a lower surface of a magnetic substrate, and a via that couples the metal wire formed on the upper surface to the metal wire formed on the lower surface.

(15)

The antenna apparatus according to (14), in which a distance between the solenoid antenna and the metal plate is larger than 0% and equal to or smaller than 200% of a thickness of the solenoid antenna.

(16)

The antenna apparatus according to (14) or (15), in which the antenna apparatus is integrated with or embedded in a substrate.

(17)

A communication apparatus including:

a solenoid-coil-type solenoid antenna; and a metal plate disposed to have an overlapping portion with the solenoid antenna in a length direction of the solenoid antenna, the metal plate forming a portion of a housing, the housing containing the solenoid antenna, and a portion of the solenoid antenna overlapping with the metal plate, and a remaining portion of the solenoid antenna being disposed in a slit portion.

REFERENCE SIGNS LIST

21: antenna apparatus
22: solenoid antenna
23: metal plate
101: metal plate
102: slit
201: metal plate

The invention claimed is:

1. An antenna apparatus, comprising:

a solenoid-coil-type solenoid antenna; and a metal plate that has an overlapping portion with the solenoid antenna in a length direction of the solenoid antenna, wherein the metal plate has a slit and a hole, the hole is on a first side of the metal plate and the slit is on a second side of the metal plate, the first side of the metal plate is opposite to the second side of the metal plate, and the solenoid antenna is in parallel to the slit.

2. The antenna apparatus according to claim 1, wherein the overlapping portion comprises a portion corresponding to a length of 50% to 80% of a length of the solenoid antenna.

3. The antenna apparatus according to claim 1, wherein the overlapping portion comprises a portion corresponding to a length of 0% to 100% of a length of the solenoid antenna.

4. The antenna apparatus according to claim 1, wherein the slit has a width at least equal to one time of a width of the solenoid antenna.

5. The antenna apparatus according to claim 1, wherein the hole is below a center core of the solenoid antenna.

6. The antenna apparatus according to claim 1, wherein the slit and the hole do not overlap with each other.

7. The antenna apparatus according to claim 1, wherein the solenoid antenna is at a position that is not in contact with the metal plate, and the solenoid antenna maintains a shortest distance from the metal plate.

8. The antenna apparatus according to claim 1, wherein a distance between the solenoid antenna and the metal plate is larger than 0% and equal to or smaller than 100% of a diameter of the solenoid antenna.

9. The antenna apparatus according to claim 1, wherein the metal plate functions as a housing.

10. The antenna apparatus according to claim 1, wherein the metal plate includes one of non-metal covered with metal or non-metal in complex with metal.

11. The antenna apparatus according to claim 1, wherein the solenoid antenna includes a solenoid that includes a magnetic material as a core material and a metal wound around the core material.

12. The antenna apparatus according to claim 1, wherein the solenoid antenna includes metal wires linearly on an upper surface and a lower surface of a magnetic substrate, and a via that couples the metal wires on the upper surface to the metal wires on the lower surface.

13. The antenna apparatus according to claim 12, wherein a distance between the solenoid antenna and the metal plate is larger than 0% and equal to or smaller than 200% of a thickness of the solenoid antenna.

14. The antenna apparatus according to claim 12, wherein the antenna apparatus is one of integrated with or embedded in a substrate.

15. A communication apparatus, comprising:

a solenoid-coil-type solenoid antenna; and a metal plate that has an overlapping portion with the solenoid antenna in a length direction of the solenoid antenna, wherein the metal plate is a portion of a housing, the housing further contains the solenoid antenna, a portion of the solenoid antenna overlaps with the metal plate, and a remaining portion of the solenoid antenna is in a slit portion.

16. An antenna apparatus, comprising:

a solenoid-coil-type solenoid antenna; and a metal plate that has an overlapping portion with the solenoid antenna in a length direction of the solenoid antenna, wherein the metal plate has a slit, the solenoid antenna is in parallel to the slit, and the slit has a width at least equal to one time of a width of the solenoid antenna.

* * * * *